US006203664B1

(12) United States Patent
Oriaran et al.

(10) Patent No.: US 6,203,664 B1
(45) Date of Patent: Mar. 20, 2001

(54) HYDROPHILIC, HUMECTANT, SOFT, PLIABLE, ABSORBENT PAPER HAVING WET STRENGTH AGENTS

(75) Inventors: T. Philips Oriaran, Appleton; Byron E. Burrier, Neenah; Henry S. Ostrowski, Appleton; Elroy W. Post; Jacob H. Propp, both of Oshkosh, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/578,169

(22) Filed: May 24, 2000

Related U.S. Application Data

(60) Division of application No. 09/264,575, filed on Mar. 8, 1999, which is a continuation-in-part of application No. 08/851,657, filed on May 6, 1997, now Pat. No. 6,017,418, which is a continuation-in-part of application No. 08/770,929, filed on Dec. 23, 1996, now abandoned.

(51) Int. Cl.[7] ..... D21H 17/45; B31F 1/12

(52) U.S. Cl. ..... 162/111; 162/164.6; 162/123; 162/127; 162/166; 428/154

(58) Field of Search ..... 162/111–113, 123, 162/127, 164.6, 166, 158; 428/153–154

(56) References Cited

U.S. PATENT DOCUMENTS 4,113,934 * 9/1978 Panzer et al. ..... 526/258
4,432,834 * 2/1984 Whitfield et al. ..... 162/158
4,720,383 * 1/1988 Drach et al. ..... 424/70
5,399,240 * 3/1995 Graef et al. ..... 162/9
5,399,241 * 3/1995 Oriaran et al. ..... 162/112
5,494,731 * 2/1996 Fereshtehkhou et al. ..... 428/211
5,552,020 * 9/1996 Smith et al. ..... 162/164.4
5,695,607 * 12/1997 Oriaran et al. ..... 162/112

* cited by examiner

*Primary Examiner*—Stanley S. Silverman
*Assistant Examiner*—Jose A. Fortuna

(57) ABSTRACT

The invention relates to hydrophilic, humectant, soft, pliant, single-ply or multi-ply absorbent papers in the form of a bathroom tissue. These humectant paper products are formed by supplying a furnish to headbox comprising: Cellulosic papermaking fiber consisting essentially of recycle fiber, hardwood fiber, softwood fiber, and mixtures thereof; and optionally up to 50% synthetic fibers and a softener which has a melting range of about 0°–40°C. wherein the softener comprises an imidazoline moiety formulated in organic compounds selected from the group consisting of alkoxylated aliphatic polyols, alkoxylated aliphatic diols, aliphatic polyols, aliphatic diols and a mixture of these compounds, wherein the process of adding the softener is controlled to retain a ratio of the average particle size of dispersed softener to the average fiber diameter in the range of about 0.01 to 15 percent: wet pressing said nascent web, creping said web from said Yankee, and recovering the paper products. These products are also suitably prepared using through drying methods with or without the use of a Yankee Dryer, and the products exhibit a unique combination of properties designed to appeal to consumer preferences. In many applications, these products not to be creped, and in that case they do not have the serpentine configuration.

23 Claims, 11 Drawing Sheets

(1 of 11 Drawing Sheet(s) Filed in Color)

EMBOSS PATTERN

HYDROPHILIC, HUMECTANT, SOFT, PLIABLE, ABSORBENT PAPER HAVING WET STRENGTH AGENTS

RELATED APPLICATIONS

This application is a division of application Ser. No. 09/264,575 filed Mar. 8, 1999, which is a continuation-in-part of Ser. No. 08/851,657, filed May 6, 1997, now U.S. Pat. No. 6,017,418, which is a continuation-in-part of Ser. No. 08/770,929, filed Dec. 23, 1996, now abandoned.

BACKGROUND OF THE INVENTION

This invention relates to hydrophilic, humectant, soft, pliable, absorbent paper having wet strength agents and a method for its manufacture. The absorbent paper products of this invention such as napkins, bathroom tissue, facial tissue, and towels are exceedingly soft to the touch yet strong enough to withstand vigorous use. The pleasingly soft touch to the human skin is achieved by the use of cationic softeners having humectancy properties and also melting points in the range of about 0° to 40° C. Cationic softeners which exhibit humectancy properties and are liquid at ambient temperatures produce a hydrophilic, humectant, soft, absorbent paper product. The usual cationic softeners do not exhibit humectancy properties and have much higher melting points and therefore do not impart the soft, hydrophilic, humectant properties to the absorbent paper.

In general, the prior art method of imparting softness to cellulosic tissue paper sheets is to apply work to the sheets. For example, at the end of most conventional tissue papermaking processes, the sheets are removed from the surface of a thermal drying means, such as a Yankee drum, by creping them with a doctor blade. Such creping breaks many of the inter-fiber hydrogen bonds throughout the entire thickness of the sheet. However, such simple creping produces tissue paper that is neither as soft nor as strong as is desirable.

The prior art therefore turned to treating cellulosic tissue paper sheets or their cellulosic web precursor, with chemical debonding agents that disrupt the inter-fiber hydrogen bonds. See, e.g., U.S. Pat. Nos. 4,144,122; 4,372,815; and 4,432,833.

For example, U.S. Pat. Nos. 3,812,000; 3,844,880; and 3,903,342 disclose the addition of chemical debonding agents to an aqueous slurry of cellulosic fibers. Generally, these agents are cationic quaternary amines such as those described in U.S. Pat. Nos. 3,554,863 and 3,395,708. Other references disclose adding the chemical debonding agent to a wet cellulosic web. See, U.S. Pat. No. 2,756,647 and Canadian Patent No. 1,159,694. These prior art methods have been found to produce hydrophobic paper products which are not comparable to the hydrophilic, humectant, soft, pliable, absorbent paper product of this invention.

Paper webs or sheets find extensive use in modern society. These include such staple items as paper towels, facial tissues, sanitary (or toilet) tissues, and napkins. These paper products can have various desirable properties, including wet and dry tensile strength, absorbency for aqueous fluids (e.g., wettability), low lint properties, desirable bulk, and softness. The particular challenge in papermaking has been to appropriately balance these various properties to provide superior absorbent paper.

Although desirable for towel products, softness is a particularly important property for facial and toilet tissues and napkins. Softness is the tactile sensation perceived by the consumer who holds a particular paper product, rubs it across the skin, and crumples it within the hand. Such tactile perceivable softness can be characterized by, but is not limited to, friction, flexibility, and smoothness, as well as subjective descriptors, such as a feeling like velvet, silk, or flannel. This tactile sensation is a combination of several physical properties, including the flexibility or stiffness of the sheet of paper, as well as the texture of the surface of the paper.

Wet strength is enhanced by the inclusion of certain wet strength resins, that, being typically cationic, are easily deposited on and retained by the anionic carboxyl groups of the papermaking fibers. However, the use of chemical means to improve dry and wet tensile strength can also result in stiffer, harsher feeling, less soft, absorbent papers. This, however, is not the case for our products which contain cationic softeners. We add about 1 to 30 pounds of the wet strength resin per ton of furnish, preferably 2 to 10 pounds for bathroom and facial tissue and napkin, and preferably 5 to 20 pounds for towel. The suitable range for bathroom tissue is I to 20 pounds while for towel it is 1 to 30 pounds.

Certain chemical additives, commonly referred to as debonding agents, can be added to papermaking fibers to interfere with the natural fiber-to-fiber bonding that occurs during sheet formation and drying, and thus lead to softer papers. These debonding agents have certain disadvantages associated with their use in softening absorbent papers. Some low molecular weight debonding agents can cause excessive irritation upon contact with human skin. Higher molecular weight debonding agents can be more difficult to apply at low levels to absorbent paper and also tend to have undesirable hydrophobic effects on the absorbent paper, e.g., result in decreased absorbency and particularly wettability. Since these debonding agents operate by disrupting inter-fiber bonding, they can also decrease tensile strength to such an extent that resins, latex, or other dry strength additives can be required to provide acceptable levels of tensile strength. These dry strength additives not only increase the cost of the absorbent paper but can also have other, deleterious effects on absorbent paper softness.

Debonders serve to make a softer sheet by virtue of the fatty portion of the molecule which interferes with the normal hydrogen bonding. The use of a debonder can reduce the energy required to produce a fluff to half or even less than that required for a nontreated pulp. This advantage is not obtained without a price, however. Many debonders tend to reduce water absorbency as a result of hydrophobicity caused by the same fatty long chain portion which gives the product its effectiveness. Those interested in the chemistry of the debonders will find them widely described in the patent literature. The following list of U.S. patents provides a fair sampling, although it is not intended to be exhaustive: Hervey et al., U.S. Pat. Nos. 3,395,708 and 3,554,862; Forssblad et al., U.S. Pat. No. 3,677,886; Emanuelsson et al., U.S. Pat. No. 4,144,122; Osborne, III, U.S. Pat. No. 4,351,699; and Helisten et al., U.S. Pat. No. 4,476,323. All of the aforementioned patents describe cationic debonders. Laursen, in U.S. Pat. No. 4,303,471, describes what might be considered a representative nonionic debonder.

U.S. Pat. No. 3,844,880 to Meisel, Jr., et al. describes the use of a deposition aid (generally cationic), an anionic resin emulsion, and a softening agent which are added sequentially to a pulp furnish to produce a soft product having high wet and dry tensile strength. The opposite situation; i.e., low wet tensile strength, is preferred for a pulp which is to be later reslurried for some other use.

Croon et al, in U.S. Pat. No. 3,700,549, describe a cellulosic fiber product crosslinked with a polyhalide, polyepoxide, or epoxyhalide under strongly alkaline conditions. All of the crosslinking materials are insoluble in water. Croon et al. teach three methods to overcome this problem. The first is the use of vigorous agitation to maintain the crosslinking agent in a fine droplet-size suspension. Second is the use of a polar cosolvent such as acetone or dialkylsulfoxides. Third is the use of a neutral (in terms of being a nonreactant) water soluble salt such as magnesium chloride. In a variation of the first method, a surfactant may be added to enhance the dispersion of the reactant phase. After reaction, the resulting product must be exhaustively washed to remove the necessary high concentration of alkali and any unrelated crosslinking material, salts, or solvents. The method is suitable only for cellulosic products having a relatively high hemicellulose content. A serious deficiency is the need for subsequent disposal of the toxic materials washed from the reacted product. The Croon et al. material would also be expected to have all other well known disadvantages incurred with trying to use a stiff, brittle crosslinked fiber.

SUMMARY OF THE INVENTION

The hydrophilic, humectant, soft, pliant single-ply or multi-ply absorbent papers of this invention having wet strength agents are advantageously prepared by techniques falling into five categories, four of which are required and the other one is optional. It is critical when producing hydrophilic, humectant, soft, pliant single-ply or multi-ply absorbent papers such as napkins and bathroom tissues that the (1) softener has a melting point of about 0° to 40° C. and comprises an imidazoline moiety formulated with aliphatic polyols, aliphatic diols, alkoxylated aliphatic polyols, alkoxylated aliphatic diols, or in a mixture of these compounds; (2) that the softener has humectancy, that means the softener displays a two-fold moisturizing action, (a) water retention, and (b) water absorption; (3) the process of adding the softener is controlled to achieve a ratio of the average particle size of the dispersed softener to the average fiber diameter in the range of about 0.01 to about 15 percent; (4) the temporary or permanent wet strength agents should be added to the furnish or on the web wherein the amount of the wet strength agent added is about 1 to 30 pounds per ton of furnish and optionally the web is embossed. For single-ply napkins, various emboss designs were found suitable. Representative designs are set forth in FIGS. 4 and 11. The furnish may include up to 50% synthetic fiber, the remainder being a mixture of softwood, hardwood, and recycle fiber. The synthetic fibers are manufactured polymers or copolymers selected from the group consisting of polyethylene, polypropylene, polyester, polyamide and polyacrylic moieties. It is critical that the absorbent paper have retained humectants. Humectants are hygroscopic materials with a two fold moisturizing action. They retain water and they facilitate absorption of the water from outside sources. The low melting softener formulations utilized in this invention function as humectants and provide some of the unique properties of the novel absorbent paper of this invention.

Further advantages of the invention will be set forth in part in the description which follows. The advantages of the invention may be realized and attained by means of the instrumentalities and combinations particularly pointed out in the appended claims.

To achieve the foregoing advantages and in accordance with the purpose of the invention as embodied and broadly described herein, there is disclosed:

A wet press process for the manufacture of a hydrophilic, humectant, soft, pliant single-ply or multi-ply absorbent paper which process comprises:

providing a moving foraminous support;

providing a headbox;

said moving foraminous support adapted to form a nascent web by depositing furnish upon said foraminous support;

providing wet pressing means operatively connected to said moving foraminous support to receive said nascent web and for dewatering of said nascent web by overall compaction thereof;

providing a Yankee dryer operatively connected to said wet pressing means and adapted to receive and dry the dewatered nascent web;

supplying a furnish and cationic wet strength agents to said headbox or alternatively spraying uncharged or charged wet strength agents on the Yankee surface or just prior to or after creping wherein the amount of the wet strength agent added is about 1 to 30 pounds per ton of furnish comprising:

cellulosic papermaking fiber consisting essentially of recycle fiber, hardwood fiber, softwood fiber, and mixtures thereof, and a cationic softener having a melting point of about 0° to 40° C. exhibiting humectancy properties and comprising an imidazoline moiety formulated with aliphatic polyols, aliphatic diols, alkoxylated aliphatic diols, alkoxylated aliphatic polyols, or in a mixture of these compounds wherein the process of adding the softener is controlled to achieve a ratio of the average particle size of the dispersed softener to the average fiber diameter in the range of about 0.01 to about 15 percent;

forming a nascent web by depositing the furnish on the moving foraminous support;

wet pressing said nascent web; transferring said nascent web to said Yankee dryer, adhering said web to said Yankee, creping said web from said Yankee; recovering a creped, dried absorbent paper product having a serpentine configuration.

This process is applicable for the manufacture of hydrophilic, humectant, soft, pliant single-ply or multi-ply absorbent bathroom tissue, napkins, facial tissue, and towel. The absorbent papers of this invention have a basis weight of about 6 to 32 pounds per 3000 square foot ream and the creped paper products have a serpentine configuration. The softener is suitably added to the furnish, sprayed on the nascent web, or applied to the creped web. In the novel process, about 50 to 85 percent of the softener added is retained on the absorbent paper sheet. The absorbent paper of this invention is also suitably manufactured utilizing the through air (TAD) process as shown in FIG. 2.

A TAD process for the manufacture of a hydrophilic, humectant, soft, pliant, single-ply or multi-ply absorbent paper comprises:

providing a moving foraminous support;

providing a headbox;

said moving foraminous support adapted to form a nascent web by depositing furnish upon said foraminous support;

providing means operatively connected to said moving foraminous support to receive said nascent web and for dewatering of said nascent web as with a vacuum box and partly through air drying the web; and providing a Yankee dryer operatively connected to said moving foraminous support and said wet pressing means and adapted to receive and dry the partially dried nascent web;

supplying a furnish and cationic wet strength agents to the headbox or alternatively spraying uncharged or charged wet strength agents on the Yankee surface or just prior to or after creping wherein the amount of the wet strength agent added is about 1 to 5 pounds per ton of furnish comprising:

cellulosic papermaking fiber consisting essentially of recycle fiber, hardwood fiber, softwood fiber, and mixtures thereof, and a softener having a melting point of about 0° to 40° C. comprising an imidazoline moiety and aliphatic diols, aliphatic polyols, alkoxylated aliphatic diols, alkoxylated aliphatic polyols or in a mixture of these compounds wherein the process of adding the softener is controlled to achieve a ratio of the average particle size of the dispersed softener to the average fiber diameter in the range of about 0.01 to about 15 percent;

forming a nascent web by depositing said furnish on said moving foraminous support;

partially through air drying the web; transferring said nascent web to said Yankee dryer, adhering said web to said Yankee, creping said web from said Yankee; recovering a creped, dried absorbent paper product having a serpentine configuration.

The TAD process is also applicable to the manufacture of hydrophilic, humectant, soft, single-ply or multi-ply absorbent bathroom tissue, napkins, facial tissue, and towel.

Advantageously, in one embodiment of our invention, creping is not used in the papermaking process and optionally dryers other than the Yankee may be used. When the sheet is not creped, the absorbent paper product does not have a serpentine configuration. Our process is further set out in Example 43. Certain uncreped TAD processes are disclosed in U.S. Pat. Nos. 5,607,551 and 5,048,589 and European Patent Applications EP 0677612A3 and EP 0617164A1 all incorporated herein in the entirety by reference.

The uncreped TAD process is identical to the creped TAD process except that a creping blade is not utilized and optionally drying means other than Yankee dryers are utilized. Suitably, the uncreped TAD process can utilize a Yankee dryer but other dryers known in the art are equally suitable. The amount of wet strength agent added in the TAD process isabout 1 to 30 pounds per ton of furnish, for bathroom tissue 1 to 20 pounds per ton of furnish.

BRIEF DESCRIPTION OF THE DRAWINGS

The present invention will become more fully understood from the detailed description given hereinbelow and the accompanying drawings which are given by way of illustration only and thus are not limiting of the present invention. The file of this patent contains at least one drawing executed in color. Copies of this patent with color drawings are provided to the Patent and Trademark Office with payment of the necessary fee.

DETAILED DESCRIPTION OF THE PREFERRED EMBODIMENTS

Figure 1:
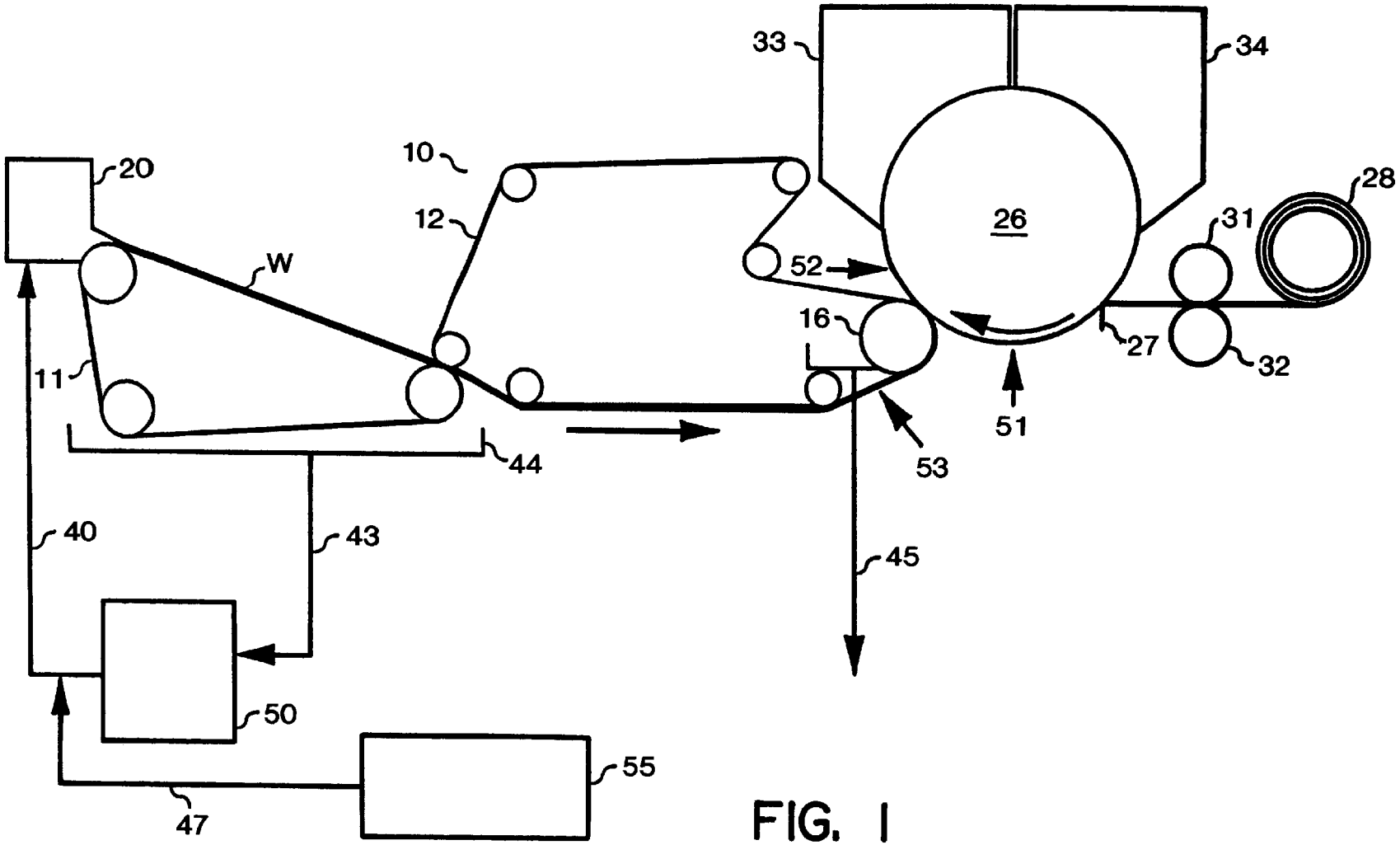
FIG. 1 is a schematic flow diagram of the papermaking process showing suitable points of optional addition of the temporary and permanent wet strength chemical moieties, and starch and softener.

The hydrophilic, humectant, soft, pliable, absorbent paper products of the present invention may be manufactured on any papermaking machine of conventional forming configurations such as fourdrinier, twin-wire, suction breast roll, or crescent forming configurations. FIG. 1 illustrates an embodiment of the present invention wherein machine chest (55) is used for preparing the papermaking furnish. Functional chemicals, particularly softening agents, are added to the furnish in the machine chest (55) or in conduit (47). Temporary or permanent wet strength agents may suitably be added at the places the softeners have been added. The amount of temporary or permanent wet strength agents is about 1 to 30 pounds per ton of furnish. For bathroom tissue it is 1 to 20 pounds, preferably 2 to 10 pounds; for towel it is 1 to 30 pounds, preferably 5 to 20 pounds per ton of furnish. The furnish may be treated sequentially with chemicals having different functionality depending on the character of the fibers that constitute the furnish, particularly their fiber length and coarseness, and depending on the precise balance of properties desired in the final product. The furnish is diluted to a low consistency, typically 0.5 percent or less, and transported through conduit (40) to headbox (20) of a paper machine (10). FIG. 1 includes a web-forming end or wet end with a liquid permeable foraminous forming fabric (11) which may be of any conventional configuration.

A wet nascent web (W) is formed in the process by ejecting the dilute furnish from headbox (20) onto forming fabric (11). The web is dewatered by drainage through the forming fabric, and additionally by such devices as drainage foils and vacuum devices (not shown). The water that drains through the forming fabric may be collected in the wire pit (44) and returned to the papermaking process through conduit (43) to silo (50), from where it again mixes with the furnish coming from machine chest (55).

From forming fabric (11), the wet web is transferred to felt (12). Additional dewatering of the wet web may be provided prior to thermal drying, typically by employing a nonthermal dewatering means. This nonthermal dewatering is usually accomplished by various means for imparting mechanical compaction to the web, such as vacuum boxes, slot boxes, contacting press rolls, or combinations thereof. The wet nascent web (W) is transferred to the drum of a Yankee dryer (26). Fluid is pressed from the wet web (W) by pressing roll (16) as the web is transferred to the drum of the Yankee dryer (26) at a fiber consistency of at least about 5% up to about 50%, preferably at least 15% up to about 45%, and more preferably to a fiber consistency of approximately 40%. The web is then dried by contact with the heated Yankee dryer and by impingement of hot air onto the sheet, said hot air being supplied by hoods (33) and (34). The web is then creped from the dryer by means of a creping blade (27). The finished web may be pressed between calender rolls (31) and (32) and is then collected on a take-up roll (28).

Adhesion of the partially dewatered web to the Yankee dryer surface is facilitated by the mechanical compressive action exerted thereon, generally using one or more pressing rolls (16) that form a nip in combination with thermal drying means (26). This brings the web into more uniform contact with the thermal drying surface. The attachment of the web to the Yankee dryer may be assisted and the degree of adhesion between the web and the dryer controlled by application of various creping aids that either promote or inhibit adhesion between the web and the dryer (26). These creping aids are usually applied to the surface of the dryer (26) at position (51) prior to its contacting the web.

Also shown in FIG. 1 are the location for applying functional chemicals to the already formed cellulosic web, particularly the charged or uncharged temporary or permanent wet strength agents (resins). Usually about 1 to 30 pounds of the wet strength resin per ton of furnish is added. According to one embodiment of the process of the invention, the temporary wet strength agent or permanent wet strength agent can be applied directly on the Yankee (26) at position (51) prior to application of the web thereto. In another preferred embodiment, the temporary or permanent wet strength agent can be applied from position (52) or (53) on the air side of the web or on the Yankee side of the web respectively. Softeners are suitably sprayed on the air side of the web from position (52) or on the Yankee side from position (53) as shown in FIG. 1. The softener/debonder and the temporary or permanent wet strength agent can also be added to the furnish prior to its introduction to the headbox (20). Again, when a starch based temporary wet strength agent is added, it should be added to the furnish prior to web formation. Suitably, charged permanent or temporary wet strength agents are also added to the furnish prior to web formation. The softener may be added either before or after the starch has been added, depending on the balance of softness and strength attributes desired in the final product. In general, charged temporary wet strength agents are added to the furnish prior to its being formed into a web, while uncharged temporary wet strength agents are added to the already formed web as shown in FIG. 1.

Figure 2:
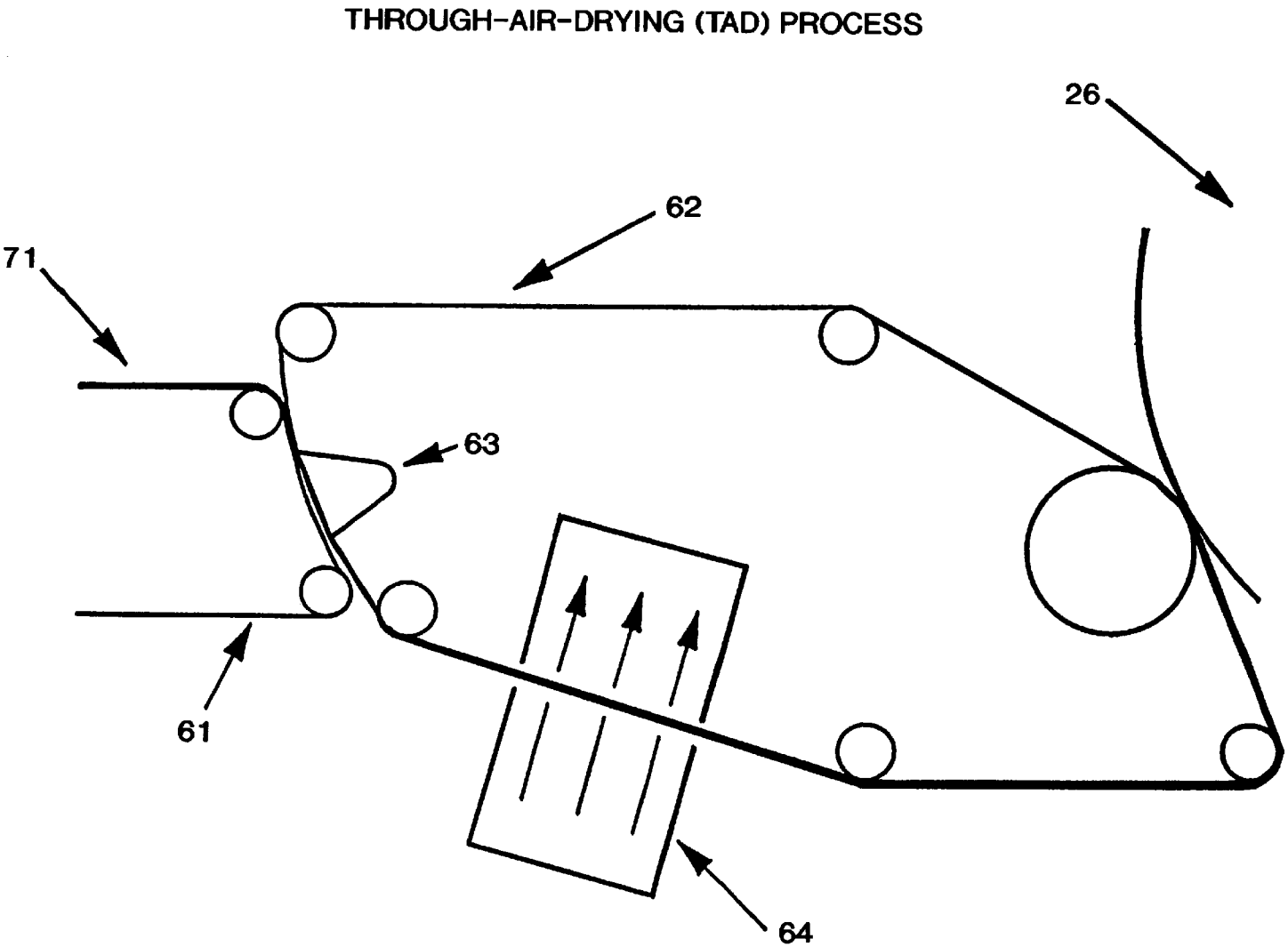
FIG. 2 illustrates a through air drying (TAD) process for the manufacture of the absorbent paper products of this invention.
Figure 3B:
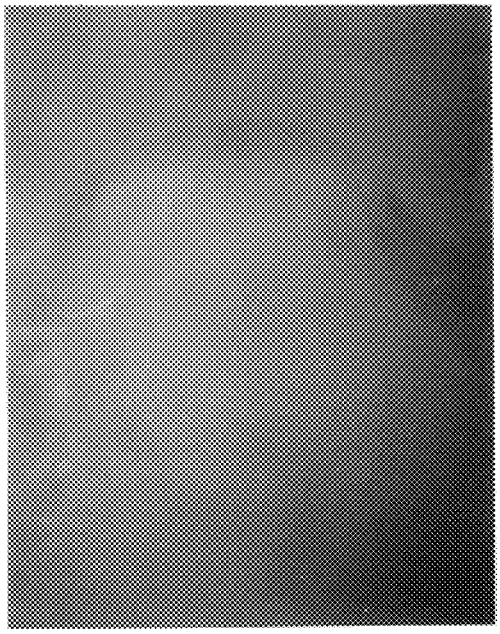
FIG. 3B is a photograph of the softener of this invention showing its dispersion.
Figure 3A:
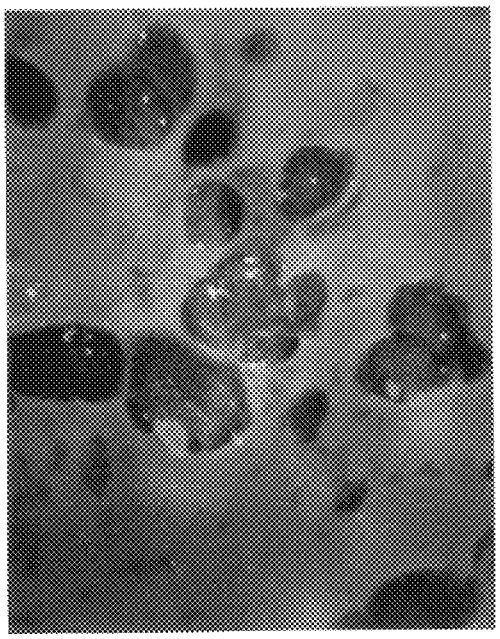
FIG. 3A PRIOR ART
FIG. 3A is a photograph of the prior art softener showing its dispersion.

The through air drying (TAD) process is illustrated in FIG. 2. In the process, wet sheet (71) that has been formed on forming fabric (61) is transferred to through air drying fabric (62), usually by means of vacuum device (63). TAD fabric (62) is usually a coarsely woven fabric that allows relatively free passage of air through both fabric (62) and nascent web (71). While on fabric (62), sheet (71) is dried by blowing hot air through sheet (71) using through air dryer (64). This operation reduces the sheet's moisture to a value usually between 10 and 95 percent. Partially dried sheet (71) is then transferred to Yankee dryer (26) where it is dried to its final desired moisture content and is subsequently creped off the Yankee. Alternatively, as shown in Example 43 and U.S. Pat. Nos. 5,607,551, 5,048,589 and European Patent Applications EP0677612A3 and EP 0617164A1, the drying can be conducted without the use of a Yankee dryer and creping. In our process any air drying means practiced in the art is suitable. All four of these references are incorporated herein by reference. The uncreped sheet does not have the serpentine configuration of the creped sheet.

Papermaking fibers used to form the hydrophilic, humectant, soft, pliable, absorbent paper products of the present invention include cellulosic fibers commonly referred to as wood pulp fibers, liberated in the pulping process from softwood (gymnosperms or coniferous trees) and hardwoods (angiosperms or deciduous trees). Cellulosic fibers from diverse material origins may be used to form the web of the present invention including non-woody fibers liberated from sugar cane, bagasse, sabai grass, rice straw, banana leaves, paper mulberry (i.e., bast fiber), abaca leaves, pineapple leaves, esparto grass leaves, and fibers from the genus Hesperaloe in the family Agavaceae. Also recycled fibers which may contain any of the above fiber sources in different percentages can be used in the present invention. Suitable fibers are disclosed in U.S. Pat. Nos. 5,320,710 and 3,620,911, both of which are incorporated herein by reference.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemi thermomechanical pulping. These mechanical pulps can be bleached, if one wishes, by a number of familiar bleaching schemes including alkaline peroxide and ozone bleaching. The type of furnish is less critical than is the case for prior art products. A significant advantage of our process over the prior art processes is that coarse hardwoods and softwoods and significant amounts of recycled fiber can be utilized to create a soft product in our process while prior art products had to utilize more expensive low-coarseness softwoods and low-coarseness hardwoods such as eucalyptus.

An important aspect of the present invention is that this softness enhancement can be achieved while other desired properties in the absorbent paper are maintained, such as by compensating mechanical processing (e.g., pulp refining) and/or the use of chemical additives (e.g., starch binders). One such property is the total dry tensile strength of the tissue paper. As used herein, "total tensile strength" refers to the sum of the machine and cross-machine breaking strengths in grams per 3 inches of the sample width. Tissue papers softened according to the present invention typically have total dry tensile strengths of at least about 360 g/3 inches, for napkins 800–4000 g/3 inches, and from about 1000 to 5400 g/3 inches for towel products.

Another property that is important for absorbent paper softened according to the present invention is its absorbency or wettability, as reflected by its hydrophilicity. Hydrophilicity of tissue paper refers, in general, to the propensity of the tissue paper to be wetted with water. Hydrophilicity of tissue paper can be quantified somewhat by determining the period of time required for dry tissue paper to become completely wetted with water. This period of time is referred to as the "wetting" (or "sinking") time.

The Simple Absorbency Tester, SAT, is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder.

De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action.

When the rate of water imbibation decreases below 0.005 gm water per 5 seconds, the test is terminated. The amount of water removed from the reservoir and absorbed by the sample is weighed and reported as grams of water per square meter of sample.

The rate or speed of absorption determination is based on the Lucas-Washburn equation as follows:

$$Q(t)=kt^{1/2}$$

where Q(t)=the amount of water absorbed at a given time t, t=time, and k=constant. This equation assumes that the amount of water absorbed at a given time during steady state flow is equal to a constant times the square root of time. If a tissue, napkin, or towel behaves according to the Lucas-Washburn equation, a plot of water absorbed versus the square root of time will yield a line with a slope equal to a constant k, where the constant is proportional to the rate of absorption. This slope is measured over the steady state portion of the absorption process and is reported in units of grams water per square root of time in seconds. A computer is employed to monitor the absorption process, determine the end-point for water holding capacity, calculate the rate of absorption, and record the results.

Simple Absorbency Test (SAT) is a method designed for determining the water holding capacity of retail roll paper towel and tissues. M/K Systems Inc. Gravimetric Absorbency Testing System is used. This is a commercial system obtainable from M/K Systems Inc., 12 Garden Street, Cambridge, Mass., 01923.

There are two calculations involved with the absorbency data. These are Water Holding Capacity (WHC) and the Initial Rate of Absorption (RATE). WHC is actually determined by the instrument itself. WHC is defined as the point where the weight versus time graph has a "zero" slope, i.e., the sample has stopped absorbing. The termination criteria for a test are expressed in maximum change in water weight absorbed over a fixed time period. This is basically an "estimate" of zero slope on the weight versus time graph. Currently the program uses a change of 0.005 g over a 5 second time interval as termination criteria. The WHC "calculation" consists of scanning the data stream for the maximum weight value and its associated time. These values are returned as the WHC and WHC time respectively.

The rate of absorption calculations are based on the Lucas-Washburn theory discussed above. As a result, if a product behaves according to the Lucas-Washburn equation, a plot of water absorbed versus the square root of time will result in a line with slope k, where k is proportional to the rate of absorption. Therefore, the slope value of a linear regression of water absorbed versus square root of time will yield the Lucas-Washburn constant k (LWK). However, due to artifacts introduced by the start of the test and a deviation from steady state flow at the end of the test due to saturation effects, the graph is not linear in its entirety. For this reason, it was decided to limit the regression to a portion of the curve. To determine the limits for the regression, a computer program was written which ran the regression multiple times while incrementally changing the regression limits. After an analysis of these runs, it was determined that a regression between 10% of the WHC and 60% of the WHC gave the best R squared value (0.99). The program employed to obtain the values used herein therefore uses these limits on a linear regression of weight absorbed versus the square root of time and returns the slope value from the regression as the rate of absorption or speed.

The preferred hydrophilicity of tissue paper depends upon its intended end use. It is desirable for tissue paper used in a variety of applications, e.g., toilet paper, to completely wet in a relatively short period of time to prevent clogging once the toilet is flushed. Preferably, wetting time is 2 minutes or less. More preferably, wetting time is 30 seconds or less. Most preferably, wetting time is 10 seconds or less.

The hydrophilicity of tissue paper can, of course, be determined immediately after manufacture. However, substantial increases in hydrophobicity can occur during the first two weeks after the tissue paper is made: i.e., after the paper has aged two (2) weeks following its manufacture; and therefore, wetting times are suitably measured at the end of such two week period.

A unique property of the cationic softeners utilized in the manufacture of the absorbent paper products is their humectancy properties. Humectants are hygroscopic materials with a two-fold moisturizing action, namely water retention and water absorption. Using this criteria, the softeners used to produce absorbent paper products of this invention all exhibit humectancy properties. Excellent pliability, softness, and absorbency in the absorbent papers of the present invention are obtained, because the unique cationic softener imparts in the treated absorbent paper these hydrophilic and humectancy properties. When the treated absorbent papers of this invention are placed in an atmosphere containing water vapor, they will pick up and retain moisture. The moisture retained helps to plasticize the treated tissue paper, and this leads to lower measured modulus, pliability and softness. Because the absorbent paper picks up and retains moisture, it also becomes "water loving" and has affinity for water. In other words, the absorbent paper product is now hydrophilic and this leads to excellent absorbent properties.

Figure 5:
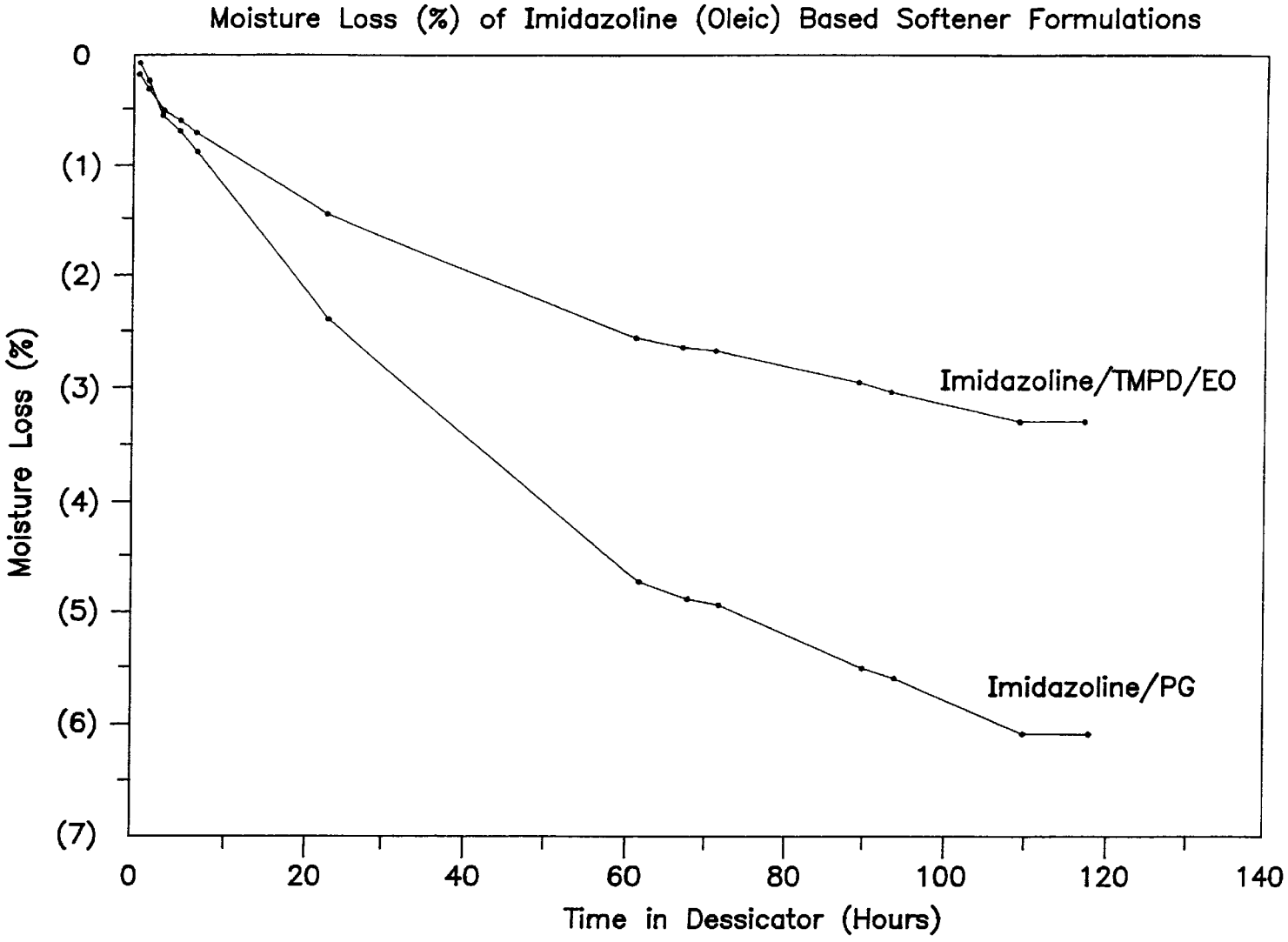
FIG. 5 is a graph illustrating the low moisture loss of the cationic softener employed in this invention compared to prior art softeners.
Figure 6:
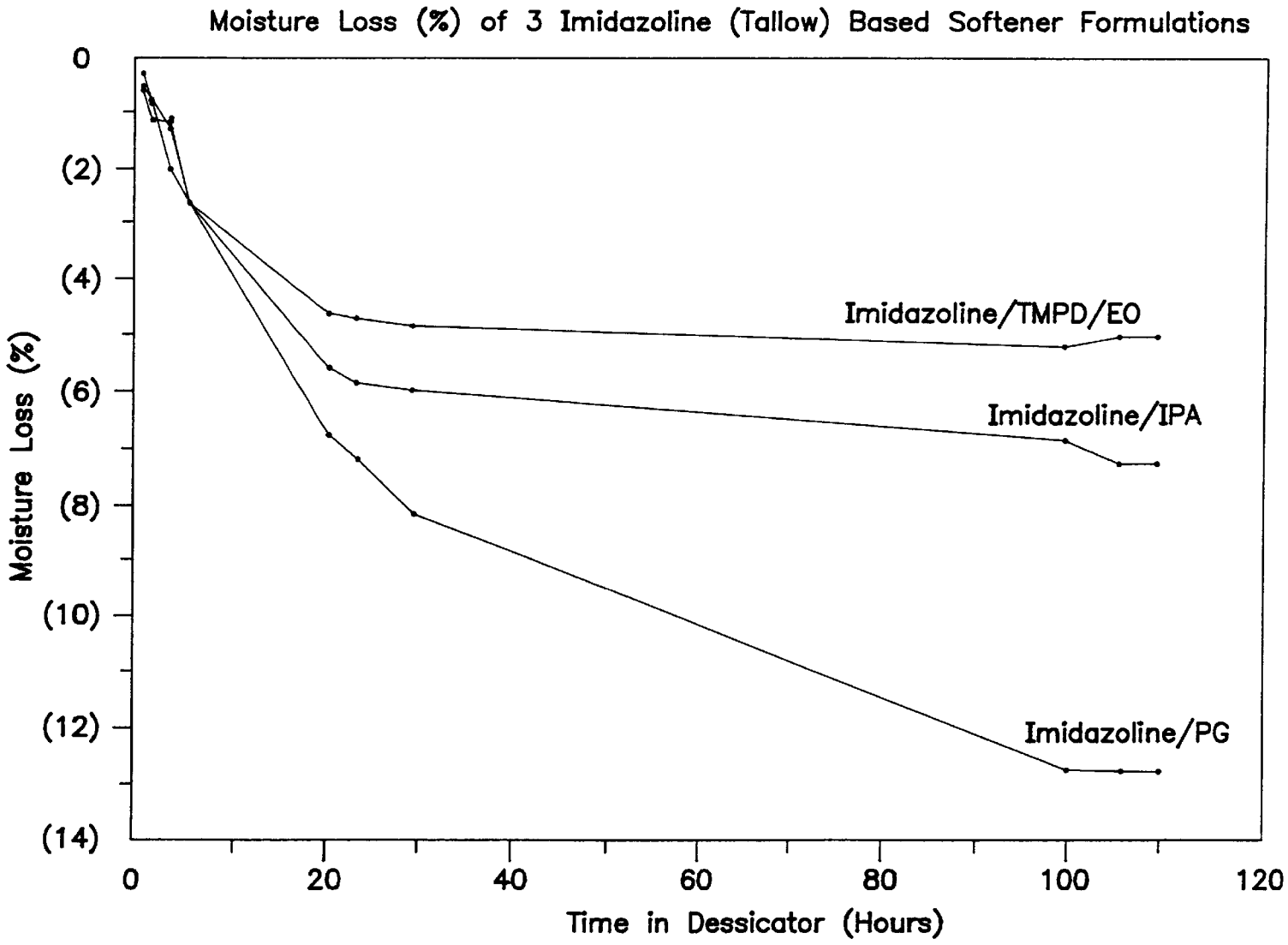
FIG. 6 is a graph illustrating the low moisture loss of the imidazoline/TMPD/EO softener versus imidazoline/IPA and imidazoline/PG softeners.
Figure 7:
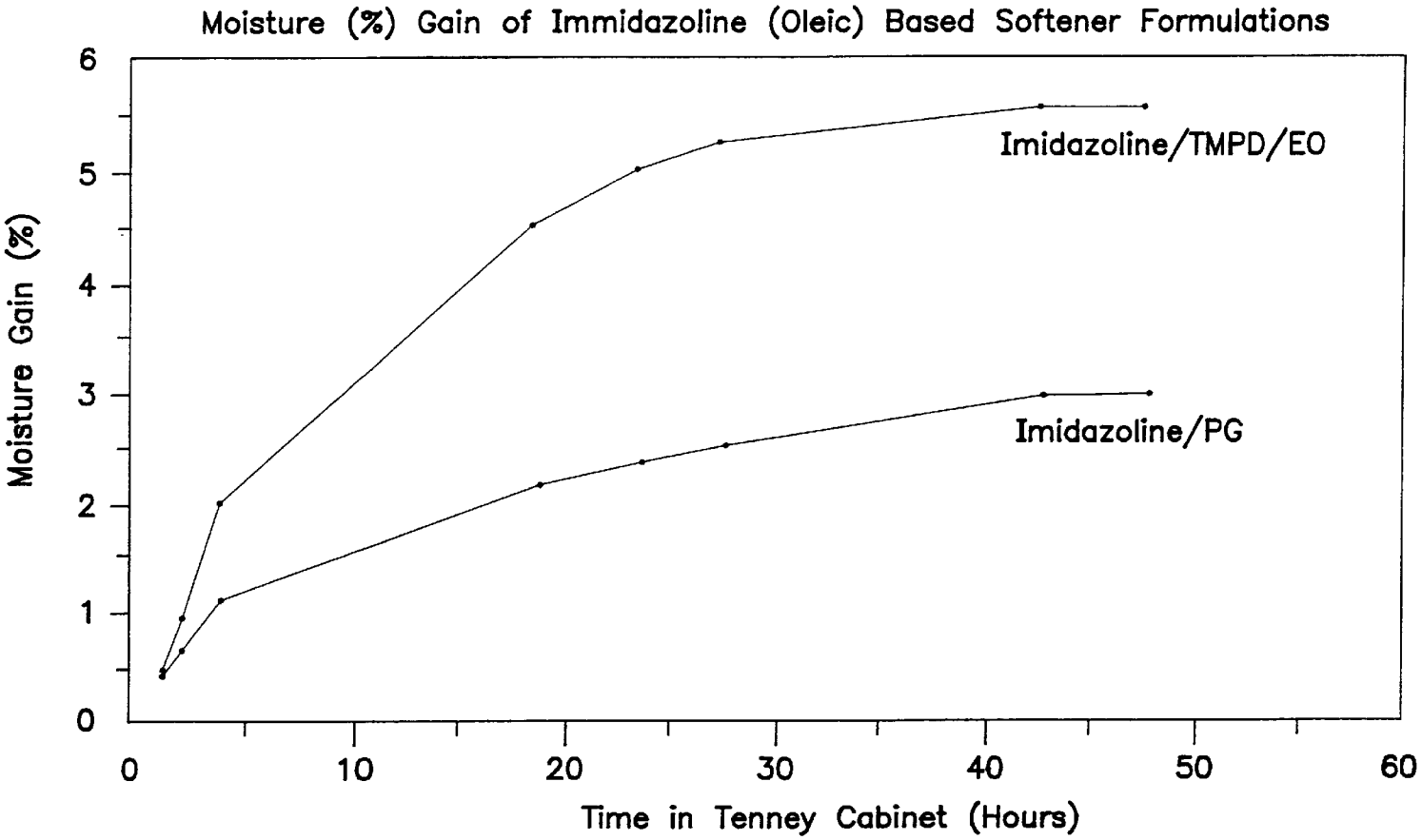
FIG. 7 is a graph illustrating the high moisture gain of the imidazoline/TMPD/EO softener utilized in this invention compared to prior art imidazoline propylene glycol softener.
Figure 8:
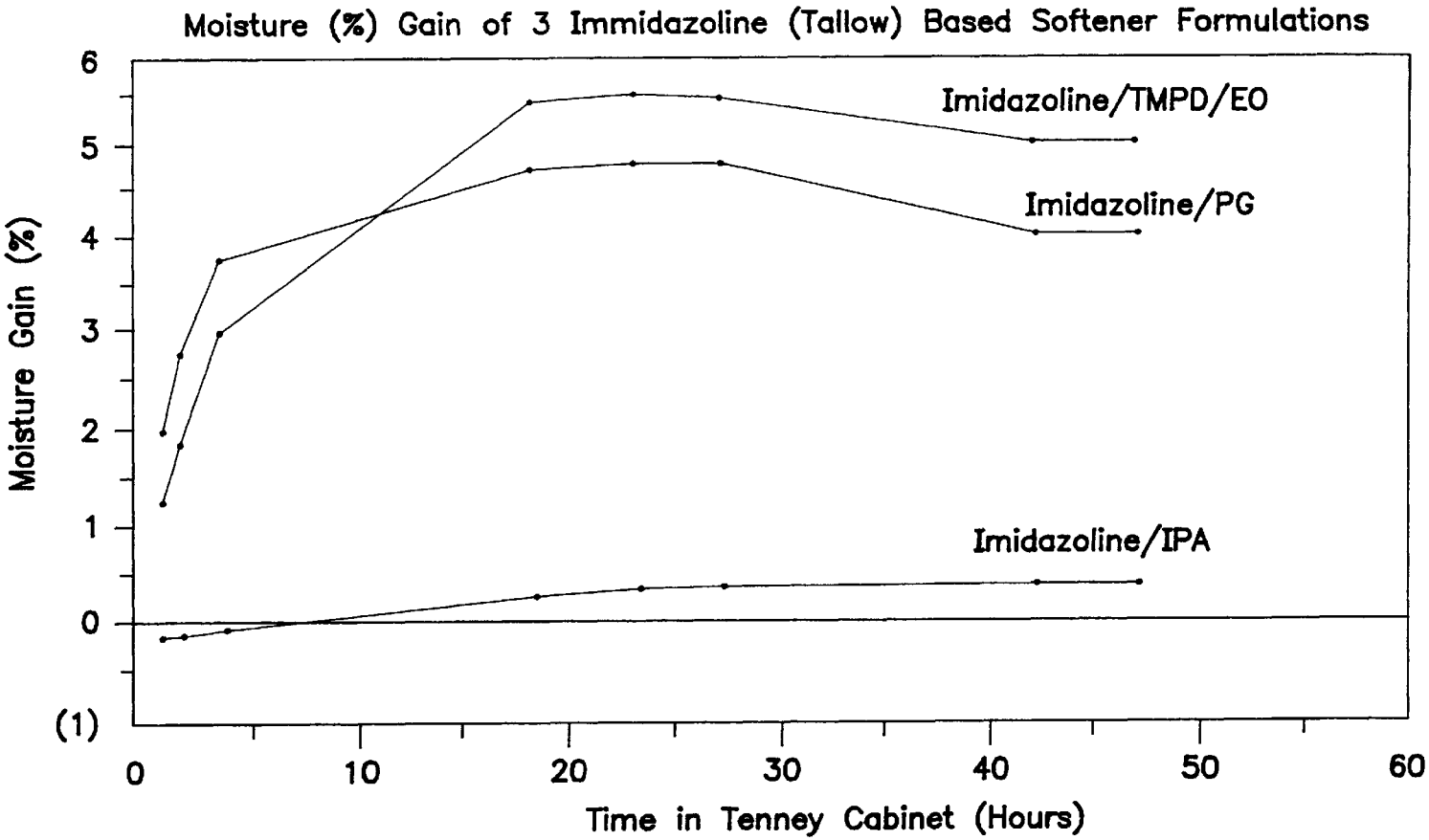
FIG. 8 is a graph illustrating the high moisture gain of the imidazoline/TMPD/EO softener compared to imidazoline/propylene glycol and imidazoline/isopropyl alcohol softeners.

The moisture retention and moisture gain can be measured by knowing initial and final moisture of a sample when placed in a controlled environment. Accordingly, softeners of the present invention can suitably gain at least four percent of their weight in moisture. Typically, the gain in moisture is more than five percent measured over a period of twenty hours in a Tinney® Cabinet. To determine the humectancy properties of the softener samples, moisture gain was determined by placing samples in a petri dish which was then placed in a Tinney® Cabinet. The Tinney® Cabinet was used to control both temperature and humidity. The temperature was maintained at 22° C., and the humidity was held at 70% relative humidity. The samples were weighed frequently at intervals displayed in FIGS. 5, 6, 7, and 8. At the end of the moisture gain experiments, each petri dish was placed in a desiccator from where each petri dish containing the samples was removed and individually weighed over the time period indicated in FIGS. 5–7.

Humectants are hygroscopic materials with a two-fold moisturizing action: water retention and water absorption. Suitable humectants manufactured by Croda Chemical Company used in connection with the softeners set forth in this application are listed in Table 1.

TABLE 1

| Product | CFTA Name/ Chemical Description | Physical Form | Activity % | Properties |
|---|---|---|---|---|
| Incromectant AMEA-100 | Acetamide MEA | Clear Viscous Liquid | 100 | Hygroscopic; Non-tacky glycerin replacements; Clarifying agents |
| Incromectant AMEA-70 | Acetamide MEA | Clear Liquid | 70 | Hygroscopic; Non-tacky glycerin replacements; Clarifying agents |
| Incromectant LMEA | Lactamide MEA | Clear Yellow Liquid | 100 | Better stability, lower odor than above |
| Incromectant LAMEA | Acetamide MEA (and) Lactamide MEA | Pale Yellow Liquid | 100 | Synergistic blend of AMEA, LMEA; Moisturizing agent superior to glycerin |
| Incromectant AQ | Acetamidopropyl Trimonium Chloride | Pale Yellow Liquid | 75 | Cationic moisture magnets |
| Incromectant LQ | Lactamidopropyl Trimonium Chloride | Clear Yellow Liquid | 75 | Cationic moisture magnets |

Additional examples of humectants suitable for use in the manufacture of absorbent paper products in combination with the softeners disclosed and claimed in this application are polyhydroxy compounds including glycerol, sorbitols, polyglycerols having a weight average molecular weight of from about 150 to about 800 and polyoxyethylene glycols and polyoxypropylene glycols having a weight average molecular weight of from about 200 to about 4000, preferably from about 200 to about 1000, most preferably from about 200 to about 600. Polyoxyethylene glycols having a weight average molecular weight of from about 200 to about 600 are especially preferred. Mixtures of the above-described polyhydroxy compounds may also be used. For example, mixtures of glycerol and polyoxyethylene glycols having a weight average molecular weight from about 200 to 1000, more preferably from about 200 to 600 are useful in the present invention. Preferably, the weight ratio of glycerol to polyoxyethylene glycol ranges from about 10:1 to 1:10.

A particularly preferred polyhydroxy compound is polyoxyethylene glycol having a weight average molecular weight of about 400. This material is available commercially from the Union Carbide Company of Danbury, Conn., under the tradename "PEG-400."

A new class of cationic softeners preferably comprising imidazolines which have a melting point of about 0–40° C. when formulated with aliphatic polyols, aliphatic diols, alkoxylated aliphatic diols, alkoxylated polyols, or a mixture of these compounds have been found suitable for use in the manufacture of absorbent paper products. These low melting softeners are useful in the manufacture of hydrophilic, humectant, soft, pliable, absorbent paper of this invention. They are also preferred in the manufacture of napkins, bathroom tissues, facial tissues, and towels. They are particularly suitable for the manufacture of one ply napkins. The softener comprising an imidazoline moiety formulated in aliphatic polyols, aliphatic diols, alkoxylated aliphatic diols, alkoxylated aliphatic polyols, or a mixture of these compounds is dispersible in water at a temperature of about 1° C. to about 40° C. The imidazoline moiety has the following chemical structure:

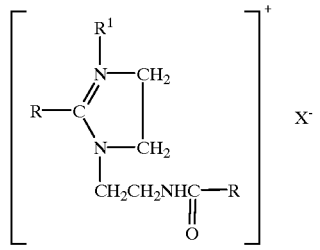

wherein X is an anion and R is selected from the group of saturated and unsaturated paraffinic moieties having a carbon chain length of $C_{11}$ to $C_{19}$. The preferred carbon chain length is $C_{16}$–$C_{19}$. $R^1$ is selected from the group of paraffinic moieties having a carbon chain length of $C_1$–$C_3$. Suitably the anion is methyl sulfate, ethyl sulfate, or the chloride moiety. The organic compound component of the softener, other than the imidazoline, is selected from aliphatic diols, alkoxylated aliphatic diols, aliphatic polyols, alkoxylated aliphatic polyols or a mixture of these compounds having a weight average molecular weight of about 60–1500. The cold water dispersed aliphatic diols have a preferred molecular weight of about 90–150, and the most preferred molecular weight of about 106–150. The preferred diol is 2,2,4 trimethyl 1,3 pentane diol (TMPD) and the preferred alkoxylated diol is ethoxylated 2,2,4 trimethyl 1,3 pentane diol. (TMPD/EO) Suitably the alkoxylated diol is TMPD (EO)n wherein n is an integer from 1 to 7 inclusive. The preferred dispersants for the imidazoline moiety are alkoxylated aliphatic diols and alkoxylated polyols. Since it is hard to obtain pure alkoxylated diols and alkoxylated polyols, mixtures of diols, polyols, and alkoxylated diols, and alkoxylated polyols, and mixtures of only diols and polyols are suitably utilized.

Figure 9:
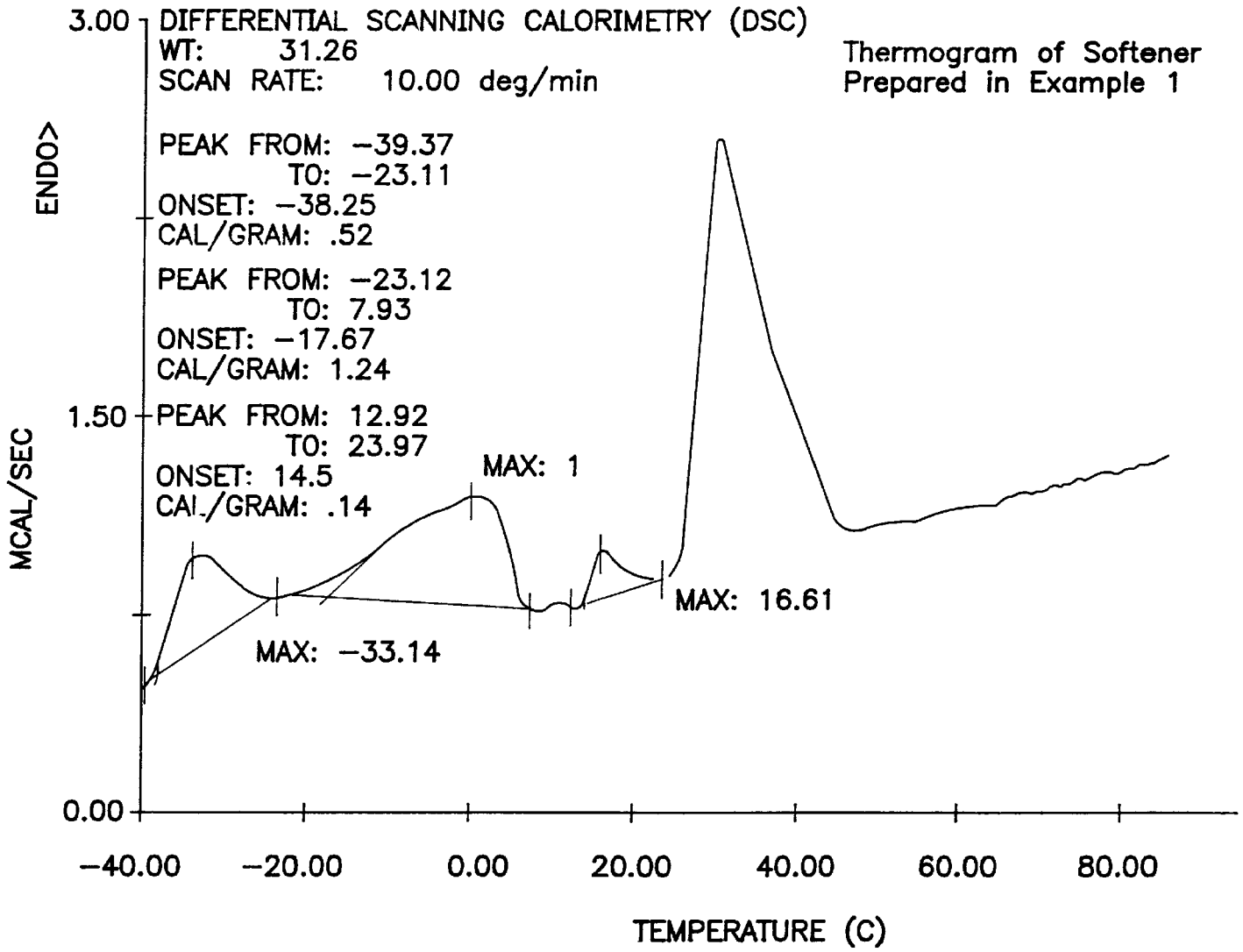
FIGS. 9 and 10 are graphs depicting the differential scanning calorimetry thermograms (DSC) of the softeners used to produce the absorbent paper of this invention.
Figure 10:
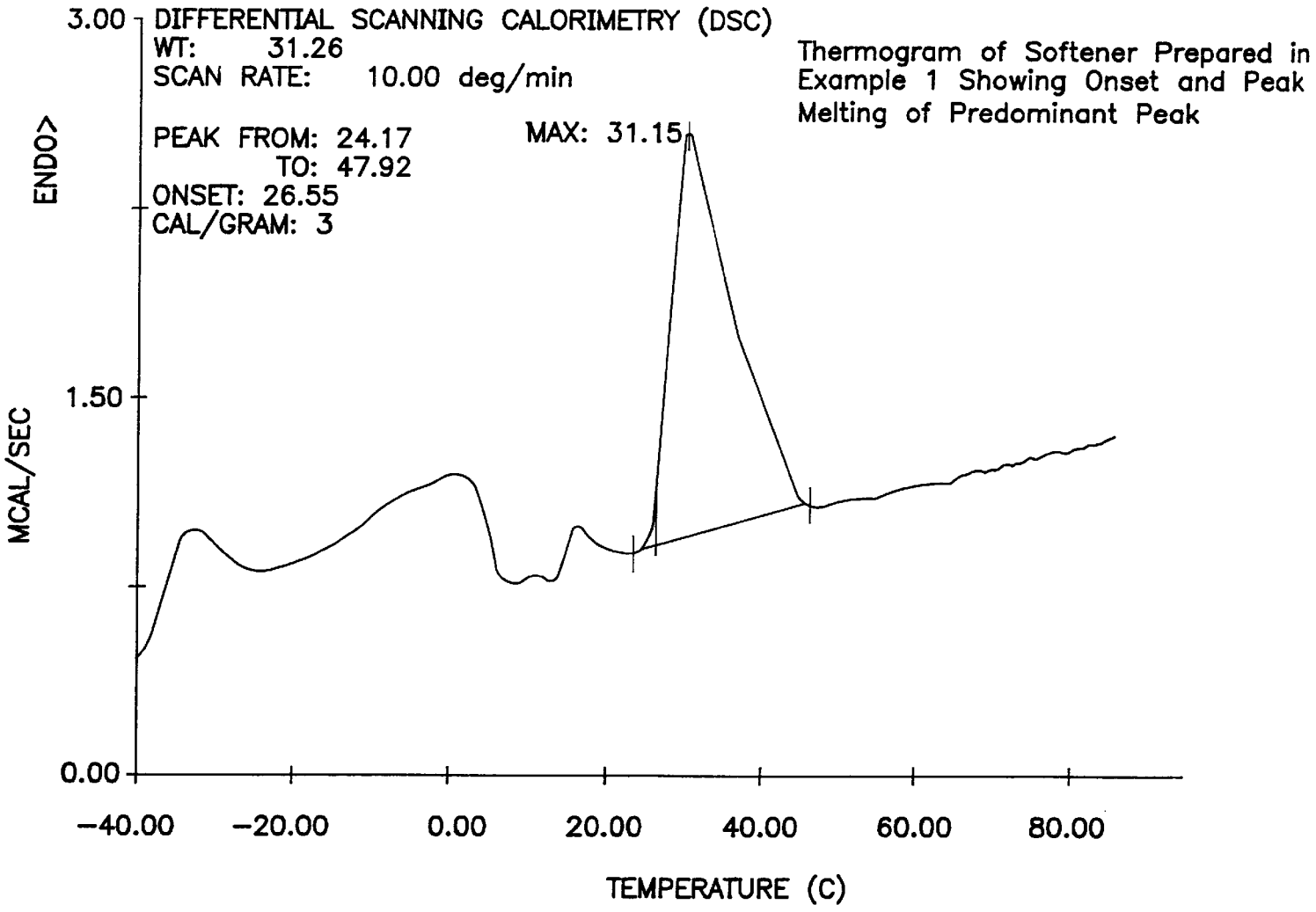

To be effective in imparting handfelt softness to treated surfaces, softeners must be able to impart a lubricious feel to the treated paper. The ability to accomplish this requires that the active ingredients of the softener begin melting at or below body temperature (37° C.). The temperatures at which the various active components of the cationic softener of this invention begin to melt, and the temperatures at which they are completely melted can be quantified by a differential scanning calorimetry (DSC). FIGS. 9 and 10 illustrate the melting properties as measured by the DSC thermogram of a preferred softener comprising mixtures of imidazoline moiety, alkoxylated diol and a diol. The predominant endothermic peak in FIGS. 9 and 10 exhibits onset of melting at 26° C. and maximum melting at 31° C., respectively. Further data interpretation can be obtained from Wendlandt, Thermal Analysis, 3rd Edition.

The melting data were determined with the Perkin-Elmer DSC4 instrument, which had been temperature-calibrated with an indium metal standard ($T_{melting}$=156.60±0.22° C. and ΔH=6.80±0.03 calories per gram). Samples were placed into analysis pans at room temperature, inserted into the instrument, cooled to −45° C., then taken through a heat/quick cool/heat regimen from −45 to 100° C. at a heating rate of 10° C. per minute. The quick cooling rate was at 320° C. per minute.

The ability to do "wet addition" with the imidazoline containing softeners can not only make the process of the present invention simpler, but also provide tensile strength advantages and desirable differences in the softness properties imparted to the treated paper web.

The humectancy and low melting point of the softeners retained in the absorbent paper products of this invention give these products a pleasing feel and softness. FIGS. 5, 6, 7, and 8 illustrate the moisture retention and moisture absorption properties of the imidazoline in TMPD/EO versus imidazolines in different solvents such as isopropanol and propylene glycol. The softeners utilized in this invention are classified as humectants, that is compounds which retain water and absorb water.

An aqueous dispersion of softener is suitably made by mixing appropriate amounts with deionized water at room temperature. Mixing is advantageously accomplished by using a magnetic stirrer operated at moderate speeds for a period of one minute. Suitable softener dispersion composition is set forth in Table 2.

TABLE 2

| | |
|---|---|
| Imidazoline | 60–80 weight percent |
| TMPD (2,2,4 trimethyl 1,3 pentane diol) | 5–15 weight percent |
| TMPD-1EO (ethoxylated TMPD) | 5–15 weight percent |
| TMPD-2EO (ethoxylated TMPD) | 0–8 weight percent |
| TMPD-3EO (ethoxylated TMPD) | 0–3 weight percent |
| TMPD-4EO (ethoxylated TMPD) | 0–3 weight percent |
| Other | 0–3 weight percent |

TMPD(EO)n wherein n is an integer having a value of 1 to 7 in combination with TMPD are suitable solvents for the imidazolines utilized herein.

Depending on the concentration of softener in water, the viscosity of the aqueous softener mixture can range from 20 to 800 cp. at room temperature. A unique feature of this dispersion is its stability under centrifugation. When the dispersion utilized herein was subjected to centrifugation for eight minutes for approximately four thousand g (force of gravity) no separation of the dispersion occurred. The distribution of the particle size of softener in the dispersion as measured by the Nicomp Submicron particle size analyzer showed that approximately 8–16 percent of the dispersion had a particle size of approximately 150–170 nanometers, and 80–92 percent of the dispersion had a particle size distribution of about 600–800 nanometers. The results in Table 17 show that at high shear and 100° C., 77% of the particles have an average diameter of about 15 nanometers.

Depending on the concentration of the softener in water, the viscosity range is suitably between 20 and 800 centipoise at room temperature. The unique hydrophilic, humectant, soft, pliant, and absorbent properties of the paper products of this invention can be attributed in large measure to the humectancy properties of the softener and also to the dispersion stability of the softener, the melting point of the softener at a temperature below 40° C. and the ratio of the average particle diameter of the dispersed softener to the average fiber diameter. Suitably the ratio of the average diameter of the dispersed softener to the average fiber diameter is 0.01 to 15 percent, advantageously 1 to 10 percent, preferably 0.3 to 5 percent. The average cellulose wood fiber utilized herein is about 0.5 to 6 mm long and has a diameter of about 10 to 60 microns. These cellulose wood fiber dimensions hold for common northern and southern softwood and hardwood pulps and for eucalyptus pulp utilized to produce the hydrophilic, humectant, soft, pliable, absorbent paper products of this invention.

The distribution of the softener particle size in cold water dispersion was evaluated with a submicron particle size analyzer. Depending on the dispersion, particle sizes in the range of about 10 to 6000 nanometer diameter were observed. For applications of the softener for the manufacture of hydrophilic, humectant, soft, pliable, absorbent paper products, advantageously the softener particle size distribution is in the range of about 100 to 1000 nanometers.

In one specific embodiment, this invention relates to a single-ply hydrophilic, humectant, soft, pliable, absorbent napkin having a basis weight in excess of 10 pounds per 3000 square foot ream, preferably 10 to 20 pounds per 3000 square foot ream prepared by:

providing a moving foraminous support;

providing a headbox;

said moving foraminous support adapted to form a nascent web by depositing furnish upon said foraminous support;

providing wet pressing means operatively connected to said moving foraminous support to receive said nascent web and for dewatering of said nascent web by overall compaction thereof;

providing a Yankee dryer operatively connected to said wet pressing means and adapted to receive and dry the dewatered nascent web;

supplying a furnish to said headbox comprising:

cellulosic papermaking fiber consisting essentially of recycle fiber, hardwood fiber, softwood fiber, and/or mixtures thereof, and adding about 1 to 20 pounds, preferably 2 to 10 pounds, per ton of furnish of a temporary or permanent wet strength agent. The wet strength agent can be added at the headbox for charged wet strength resins or at the dry end on the Yankee; and before the Yankee or after the Yankee for uncharged or charged wet strength agents. A softener is also added. This softener suitably has a melting point of about 0°–40° C. comprising an imidazoline moiety and alkoxylated aliphatic polyols, alkoxylated aliphatic diols, aliphatic diols, aliphatic polyols, or a mixture of these compounds wherein the process of adding the softener is controlled to achieve a ratio of the average particle size of the dispersed softener to the ratio of the average fiber diameter in the range of about 0.01 to 15 percent, advantageously 1 to 10 percent, preferably 0.3 to 5 percent.

A nascent web is formed by depositing said furnish on the moving foraminous support;

wet pressing said nascent web and dewatering said web by overall compaction; transferring said nascent web to the Yankee dryer, adhering said web to said Yankee dryer, creping said web from said Yankee dryer; recovering a creped, dried hydrophilic, humectant, soft, pliant, single-ply absorbent napkin product having a serpentine configuration wherein the MD to CD tensile ratio is about 1.0 to 4.0, preferably about 1.2 to 1.8.

The excellent pliability and softness of the one ply napkins is obtained because the softener has a melting point range below 40° C. It is believed that softeners function as a result of surface lubrication of the treated absorbent paper product such as the one ply napkin of this invention. The surface lubrication, to be effective, requires that the softeners begin to melt at 40° C. or at the body temperature of humans for maximum effect. Prior art cationic softeners melt at temperatures above 40° C.

According to this invention, a hydrophilic, humectant, soft, pliant single-ply napkin has been produced. This napkin has a basis weight of at least about 10 pounds/3000 square foot ream, said single-ply napkin was formed by wet pressing of a cellulosic web, adhering said web to a Yankee dryer and creping the web from the Yankee dryer, said single-ply napkin including a cationic nitrogenous softener having a melting point of about 0°–40° C. and comprising an imidazoline moiety formulated with organic compounds selected from the group of alkoxylated aliphatic diols, aliphatic diols, and a mixture of these compounds, wherein the process of adding the softener is controlled to produce a single-ply napkin having a serpentine configuration and a total dry tensile strength of between 800 and 4000 grams per three inches, the ratio of dry MD tensile to dry CD tensile of between 1.0 and 4.0, and a wet MD tensile about 200 to 600 grams per three inches.

The wet strength agents and softeners having a charge, usually cationic wet strength agents and softeners, can be supplied to the furnish prior to web formation, applied directly onto the partially dewatered web or may be applied by both methods in combination. Alternatively, the wet strength agent and softener may be applied to the completely dried, creped sheet, or the nascent web, either on the paper machine or during the converting process. Wet strength agents and softeners having no charge are applied at the dry end of the papermaking process such as on the dry tissue or on the nascent web.

The softener employed for treatment of the furnish is provided at a treatment level that is sufficient to impart a perceptible degree of softness to the paper product but less than an amount that would cause significant runnability and sheet strength problems in the final commercial product. The amount of softener employed, on a 100% active basis, is suitably from about 1.0 pound per ton of furnish up to about 10 pounds per ton of furnish; preferably from about 2 to about 3 pounds per ton of furnish.

The amount of temporary and permanent wet strength agent applied is suitably from about 1 pound per ton of furnish up to 5 pounds per ton of furnish, preferably 2 to 3 pounds per ton of furnish.

Treatment of the partially dewatered web with the softener can be accomplished by various means. For instance, the treatment step can comprise spraying, as shown in FIG. 1, applying with a direct contact applicator means, or by employing an applicator felt. It is often preferred to supply the softener to the air side of the web from position 52 shown in FIG. 1, so as to avoid chemical contamination of the paper making process. It has been found in practice that a softener applied to the web from either position 52 or position 53 shown in FIG. 1 penetrates the entire web and uniformly treats it.

Tensile strength of tissue produced in accordance with the present invention is measured in the machine direction and cross-machine direction on an Instron tensile tester with the gauge length set to 4 inches. The area of tissue tested is assumed to be 3 inches wide by 4 inches long. In practice, the length of the samples is the distance between lines of perforation in the case of machine direction tensile strength and the width of the samples is the width of the roll in the case of cross-machine direction tensile strength. A 20-pound load cell with heavyweight grips applied to the total width of the sample is employed. The maximum load is recorded for each direction. The results are reported in units of "grams per 3-inch"; a more complete rendering of the units would be "grams per 3-inch by 4-inch strip."

Softness is a quality that does not lend itself to easy quantification. J. D. Bates, in "Softness Index: Fact or Mirage?" *TAPPI,* Vol. 48 (1965), No. 4, pp. 63A–64A, indicates that the two most important readily quantifiable properties for predicting perceived softness are (a) roughness and (b) what may be referred to as stiffness modulus. The absorbent paper produced according to the present invention has a more pleasing texture than prior art absorbent paper of similar basis weight. Surface roughness can be evaluated by measuring geometric mean deviation in the coefficient of friction (GM MMD) using a Kawabata KES-SE Friction Tester equipped with a fingerprint-type sensing unit using the low sensitivity range. The geometric mean deviation of the coefficient of friction is then the square root of the product of the deviation in the machine direction and the cross-machine direction measured on the top and bottom surfaces of the napkin. The GM MMD of the single-ply product of the current invention is preferably no more than about 0.250, is more preferably less than about 0.215, and is most preferably about 0.150 to about 0.205. The tensile stiffness (also referred to as stiffness modulus) is determined by the procedure for measuring tensile strength described above, except that a sample width of 1 inch is used and the modulus recorded is the geometric mean of the ratio of 50 grams load over percent strain obtained from the load-strain curve. The specific tensile stiffness of said web is preferably from about 20 to about 100 g/inch/% strain and more preferably from about 30 to about 75 g/inch/% strain, most preferably from about 30 to about 50 g/inch/% strain.

*TAPPI* 401 OM-88 (Revised 1988) provides a procedure for the identification of the types of fibers present in a sample of paper or paperboard and an estimate of their quantity. Analysis of the amount of the softener/debonder chemicals retained on the absorbent paper can be performed by any method accepted in the applicable art. For the evaluation of cross sectional distribution, we prefer to use x-ray photoelectron spectroscopy XPS to measure nitrogen levels, the amounts in each level being measurable by using a tape pull procedure combined with XPS analysis of each "split." Normally the background level is quite high and the variation between measurements quite high, so use of several replicates in a relatively modern XPS system such as at the Perkin Elmer Corporation's Model 5,600 is required to obtain more precise measurements. The level of cationic nitrogenous softener/debonder can alternatively be determined by solvent extraction of the softener by an organic solvent followed by liquid chromatography determination of the softener/debonder. *TAPPI* 419 OM-85 provides the qualitative and quantitative methods for measuring total starch content. However, this procedure does not provide for the determination of waxy starches or starches that are cationic, substituted, grafted, or combined with resins. Some of these types of starches can be determined by high pressure liquid chromatography. (*TAPPI,* Journal Vol. 76, Number 3.)

To reach the attributes needed for a one ply napkin product, it is critical that the one ply napkins of the present invention be treated with a temporary wet strength agent. The same is true for bathroom tissue, and other absorbent paper products disclosed herein. It is believed that the inclusion of the temporary wet strength agent allows the product to hold up in use despite its relatively low level of dry strength, which is necessary to achieve the desired high softness level in a one-ply product. The amount of temporary wet strength agent added is about 1 to 5 pounds per ton of furnish, preferably 2 to 3 pounds for each ton of furnish. Therefore, products having a suitable level of temporary wet strength will generally be perceived as being stronger and thicker in use than will similar products having low wet strength values. Suitable wet strength agents comprise an organic moiety and suitably include water soluble aliphatic dialdehydes or commercially available water soluble organic polymers comprising aldehydic units, and cationic starches containing aldehyde moieties. These agents may be used singly or in combination with each other. Wet strength additives are required for one ply products but are advantageously used in two and multi-ply products.

Suitable wet strength agents include glyoxylated poly (acrylamide co-diallyl dimethyl ammonium chloride (DADMAC), glyoxylated acrylamide, reaction products of a polyamide, polycarboxylic acid or ester, a dialdehyde, and epichlorohydrin. Reaction products of polyamido amine and a dialdehyde forming chain extended polymers which react with epichlorohydrin. Suitable wet strength agents include intra linked polyamido amine which is non thermosetting and is end capped. The preferred wet strength agent is Parez® 745 described in detail in Example 45 and Tables 18, 19, and 20.

Suitable temporary or permanent wet strength agents are aliphatic and aromatic aldehydes including glyoxal, malonic dialdehyde, succinic dialdehyde, glutaraldehyde, dialdehyde starches, polymeric reaction products of monomers or polymers having aldehyde groups and optionally nitrogen groups. Representative nitrogen containing polymers which can suitably be reacted with the aldehyde containing monomers or polymers include vinylamides, acrylamides and related nitrogen containing polymers. These polymers impart a positive charge to the aldehyde containing reaction product.

The preferred humectant softeners have been described above. The preferred wet strength agents besides Parez® 745 are polyaminamide epichlorohydrin resins. Representative resins include Kymene® 557LX marketed by Hercules. The active moieties of the wet strength agent are the azetidinium, diethylenetriamine (DETA), and aliphatic acid. Kymene® 557LX has the following structure:

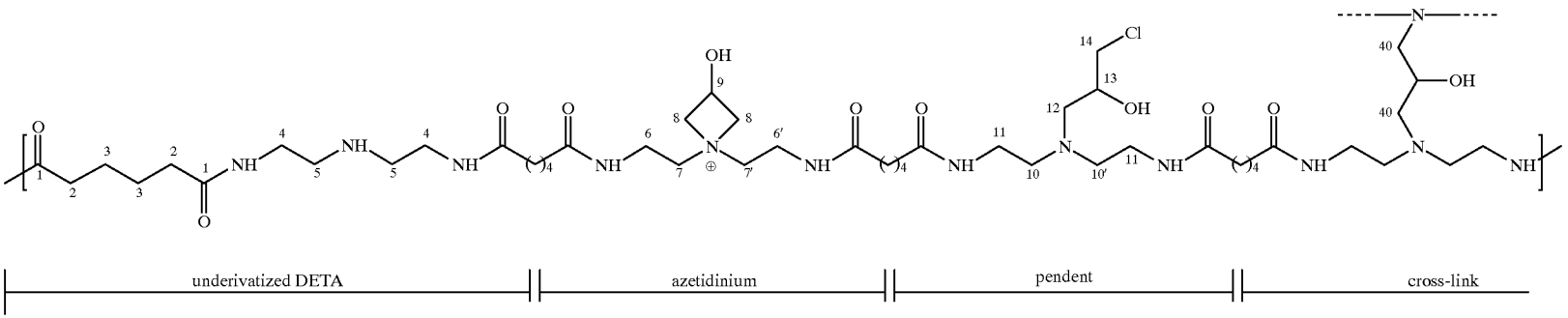
cross-link
pendent
azetidinium
underivatized DETA

Other preferred wet strength agents are suitable such as Cascamid® C-12 or LA12 marketed by Borden Chemical Company.

We have found that condensates prepared from dialdehydes such as glyoxal or cyclic urea and polyol both containing aldehyde moieties are useful for producing temporary wet strength. Since these condensates do not have a charge, they are added to the web as shown in FIG. 1 before or after the pressing roll (16) or charged directly on the Yankee surface. Suitably these temporary wet strength agents are sprayed on the air side of the web prior to drying on the Yankee as shown in FIG. 1 from position 52.

The preparation of cyclic ureas are disclosed in U.S. Pat. No. 4,625,029 herein incorporated by reference in its entirety. Other U.S. Patents of interest disclosing reaction products of dialdehydes with polyols include U.S. Pat. Nos. 4,656,296; 4,547,580; and 4,537,634 and are also incorporated into this application by reference in their entirety. The dialdehyde moieties expressed in the polyols render the whole polyol useful as a temporary wet strength agent in the manufacture of our one-ply napkins. Suitable polyols are reaction products of dialdehydes such as glyoxal with polyols having at least a third hydroxyl group. Glycerin, sorbitol, dextrose, glycerin monoacrylate, and glycerin monomaleic acid ester are representative polyols useful as temporary wet strength agents.

Polysaccharide aldehyde derivatives are suitable for use in the manufacture of absorbent paper products. The polysaccharide aldehydes are disclosed in U.S. Pat. Nos. 4,983,748 and 4,675,394. These patents are incorporated by reference into this application. Suitable polysaccharide aldehydes have the following structure:

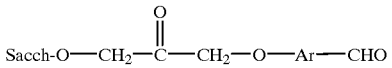

wherein Ar is an aryl group. Cationic moieties of this starch are suitable for use in the manufacture of the tissue of the present invention and can be charged with the furnish. A starch of this type can also be used without other aldehyde moieties but, in general, should be used in combination with a cationic softener.

Our novel tissue can suitably include polymers having non-nucleophilic water soluble nitrogen heterocyclic moieties in addition to aldehyde moieties. Representative resins of this type are:

A. Temporary wet strength polymers comprising aldehyde groups and having the formula:

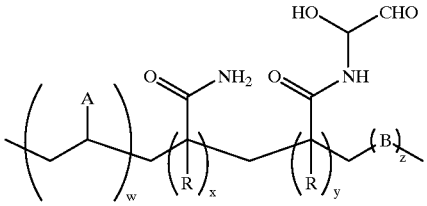

wherein A is a polar, non-nucleophilic unit which does not cause said resin polymer to become water-insoluble; B is a hydrophilic, cationic unit which imparts a positive charge to the resin polymer; each R is H, $C_1$–$C_4$ alkyl or halogen; wherein the mole percent of W is from about 58% to about 95%; the mole percent of X is from about 3% to about 65%; the mole percent of Y is from about 1% to about 20%; and the mole percent from Z is from about 1% to about 10%; said resin polymer having a molecular weight of from about 5,000 to about 200,000.

B. Water soluble cationic temporary wet strength polymers having aldehyde units which have molecular weights of from about 20,000 to about 200,000, and are of the formula:

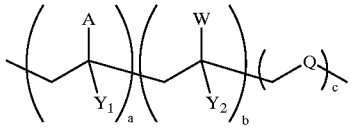

wherein A is

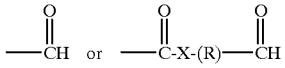

and X is —O—, —NH—, or —$NCH_3$— and R is a substituted or unsubstituted aliphatic group; $Y_1$ and $Y_2$ are independently —H, —$CH_3$, or a halogen, such as Cl or F; W is a nonnucleophilic, water-soluble nitrogen heterocyclic moiety; and Q is a cationic monomeric unit. The mole percent of "a" ranges from about 30% to about 70%, the mole percent of "b" ranges from about 30% to about 70%, and the mole percent of "c" ranges from about 1% to about 40%.

The temporary wet strength resin may be any one of a variety of water soluble organic polymer comprising aldehydic units and cationic units used to increase the dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769; and 5,217,576. Among the preferred temporary wet strength resins that may be used in the practice of the present invention are modified starches sold under the trademarks Co-Bond® 1000 and Co-Bond® 1000 Plus by National Starch and Chemical Company of Bridgewater, N.J. Prior to use, the cationic aldehydic water soluble polymer is prepared by preheating an aqueous slurry of approximately 5% solids maintained at a temperature of approximately 240° Fahrenheit and a pH of about 2.7 for approximately 3.5 minutes. Finally, the slurry is quenched and diluted by adding water to produce a mixture of approximately 1.0% solids at less than about 130° F.

Co-Bond® 1000 is a commercially available temporary wet strength resin including an aldehydic group on cationic corn waxy hybrid starch. The hypothesized structures of the molecules are set forth as follows:

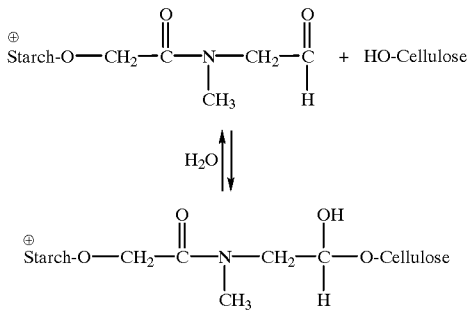

Other preferred temporary wet strength resins, also available from the National Starch and Chemical company are sold under the trademarks Co-Bond® 1600 and Co-Bond® 2500. These starches are supplied as aqueous colloidal dispersions and do not require preheating prior to use.

The web is dewatered preferably by an overall compaction process. The web is then preferably adhered to a Yankee dryer. The adhesive is added directly to the metal of the Yankee, and advantageously, it is sprayed directly on the surface of the Yankee dryer drum. Any suitable art recognized adhesive may be used on the Yankee dryer. Suitable adhesives are widely described in the patent literature. A comprehensive but non-exhaustive list includes U.S. Pat. Nos. 5,246,544; 4,304,625; 4,064,213; 4,501,640; 4,528,316; 4,883,564; 4,684,439; 4,886,579; 5,374,334; 5,382,323; 4,094,718; and 5,281,307. Adhesives such as glyoxylated polyacrylamide, and polyaminoamides have been shown to provide high adhesion and are particularly suited for use in the manufacture of the one-ply product. The preparation of the polyaminoamide resins is disclosed in U.S. Pat. No. 3,761,354 which is incorporated herein by reference. The preparation of polyacrylamide adhesives is disclosed in U.S. Pat. No. 4,217,425 which is incorporated herein by reference. Typical release agents can be used in accordance with the present invention; however, the amount of release, should one be used at all, will often be below traditional levels.

The web is then creped from the Yankee dryer and calendered. The final product's machine direction stretch should be at least about 10%, preferably at least about 15%. Usually machine direction stretch of the products controlled is by fixing the % crepe. The relative speeds between the Yankee dryer and the reel are controlled such that a reel crepe of at least about 15%, preferably 18%, is maintained. Creping is preferably carried out at a creping angle of from about 65 to about 85 degrees, preferably about 70 to about 80 degrees, and more preferably about 75 degrees. The creping angle is defined as the angle formed between the surface of the creping blade's edge and a line tangent to the Yankee dryer at the point at which the creping blade contacts the dryer.

Optionally to obtain maximum softness of the one-ply napkin, the web is embossed. The web may be embossed with any art recognized embossing pattern, including, but not limited to, overall emboss patterns, spot emboss patterns, micro emboss patterns, which are patterns made of regularly shaped (usually elongate) elements whose long dimension is 0.050 inches or less, or combinations of overall, spot, and micro emboss patterns.

In one embodiment of the present invention, the emboss pattern of the one-ply product may include a first set of bosses which resemble stitches, hereinafter referred to as stitch-shaped bosses, and at least one second set of bosses which are referred to as signature bosses. Signature bosses may be made up of any emboss design and are often a design which is related by consumer perception to the particular manufacturer of the single-ply napkin.

Figure 11:
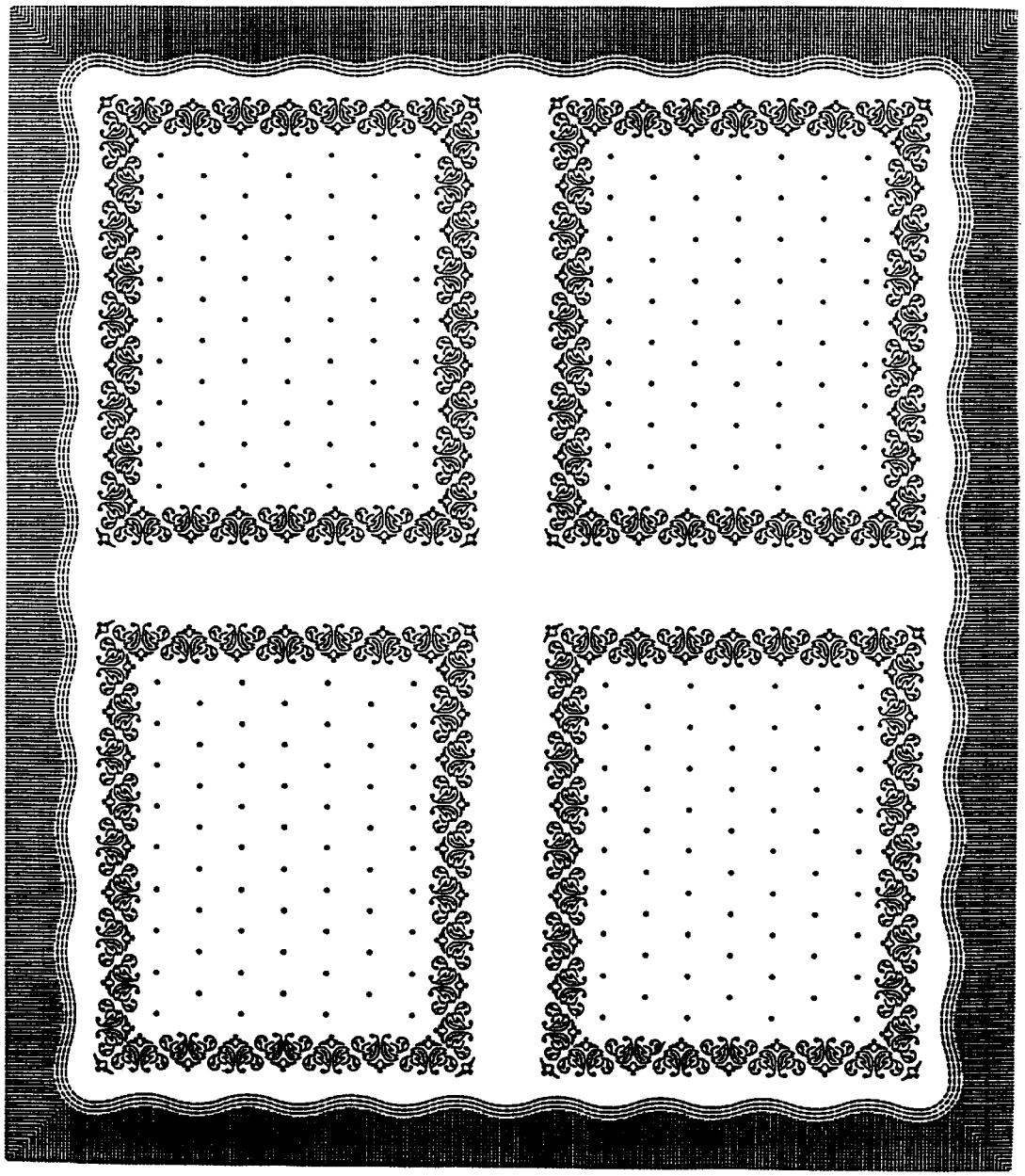

In another aspect of the present invention, a paper product is embossed with a wavy lattice structure which forms polygonal cells. These polygonal cells may be diamonds, hexagons, octagons, or other readily recognizable shapes. In one preferred embodiment of the present invention, each cell is filled with a signature boss pattern. The preferred emboss pattern for the one-ply napkin is illustrated in FIG. 11.

The basis weight of the single-ply napkin is desirably from about 10 to about 25 lbs./3,000 sq. ft. ream, preferably from about 17 to about 20 lbs./ream. The caliper of the napkin of the present invention may be measured using the Model II Electronic Thickness Tester available from the Thwing-Albert Instrument Company of Philadelphia, Pa. The caliper is measured on a sample consisting of a stack of eight sheets of napkins using a two-inch diameter anvil at a 539±10 gram dead weight load. Single-ply napkins of the present invention have a specific (normalized for basis weight) caliper after calendering and embossing of from about 30 to 70 mils per 8 plies of napkin sheets per pound per ream, the more preferred napkins have a caliper of from about 40 to about 60, the most preferred napkins have a caliper of from about 45 to about 55 and have a serpentine configuration.

Tensile strength of the one ply napkin produced in accordance with the present invention is measured in the machine direction and cross-machine direction on an Instron Model 4000: Series IX tensile tester with the gauge length set to 4 inches. The area of the napkin tested is assumed to be 3 inches wide by 4 inches long. In practice, the length of the samples is the distance between lines of perforation in the case of machine direction tensile strength and the width of the samples is the width of the roll in the case of cross-machine direction tensile strength. A 20 pound load cell with heavyweight grips applied to the total width of the sample is employed. The maximum load is recorded for each direction. The results are reported in units of "grams per 3-inch of surface width"; a more complete rendering of the units would be "grams per 3-inch by 4-inch strip." The total (sum of machine and cross machine directions) dry tensile of the present invention, will be between 800 and 4000 grams per 3 inches. The ratio of MD to CD tensile is an important physical property of the one-ply napkin and this ratio is controlled to be between 1 and 4, preferably between 1.2 and 1.8.

The wet tensile strength of the tissue and napkins of the present invention are measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. The wet tensile of the present invention will be at least 1.75 grams per three inches per pound per ream in the cross direction as measured using the Finch Cup. Normally, only the cross direction wet tensile is tested, as the strength in this direction is normally lower than that of the machine direction and the tissue is more likely to fail in use in the cross direction.

The following examples are not to be construed as limiting the invention as described herein.

EXAMPLE 1

An aqueous dispersion of softener was made in a laboratory by mixing the appropriate amount with deionized water at room temperature. Mixing was accomplished by using a laboratory magnetic stirrer operated at moderate speeds for a period of one minute. The cold water dispersible softener system consisting of 67% imidazoline and 33% TMPD-1EO was dispersed in cold water by mixing it in any proportion with cold water, using a mechanical stirrer of any common type. An example of 5 grams of the 67/33 imidazoline/TMPD-1EO was mixed with 95 grams of water at room temperature with a laboratory magnetic stirrer at moderate speed for one minute. The composition of the softener dispersion is shown in Table 3 below.

TABLE 3

| 67% Imidazoline/33% TMPD-1EOH | |
|---|---|
| Component | Weight % |
| Imidazoline | 67.0 |
| TMPD | 9.2 |
| TMPD-$(EO)_1$ | 14.8 |
| TMPD-$(EO)_2$ | 7.3 |
| TMPD-$(EO)_3$ | 1.3 |
| TMPD-$(EO)_4$ | 0.3 |
| Other | 0.1 |

Depending on the concentration of softener in water, the viscosity can range from 20 to 800 cp. at room temperature. A unique feature of this dispersion is its stability under centrifugation. A centrifuge is an instrument in which the centrifugal force of rotation is substituted for the force of gravity (g). When this dispersion was subjected to centrifugation for eight minutes at about 4000 g, no separation of the dispersion occurred.

The distribution of particle size of the cold water dispersion was evaluated with a submicron particle size analyzer. A bimodal distribution was observed in the 100 to 1000 nanometer diameter range.

The average cellulose wood fiber length is in the range of 0.5 to 6 mm long and 10 to 60 u (microns) diameter for common northern and southern softwood and hardwood pulps.

The ratio of the average particle diameter of the dispersed softener to the average fiber diameter is important for efficient use of the softener. This ratio falls in the range of 0.17 percent to 10 percent in the above example, with a mid-range value of about 1.4 percent. (Example: for a 500 nm softener particle and a 35 u diameter fiber, the ratio is 1.4 percent; $(500\times10^{-9}m/35\times10^{-6}m)\times100=1.4\%$. Suitable ranges are at least 0.01 percent and should not exceed 15 percent.

The distribution of the particle size of softener in the dispersion as measured by the Nicomp Submicron particle size analyzer is presented in Table 4:

TABLE 4

| Weight % | Particle Size (nanometers) |
|---|---|
| 12 | 162 |
| 88 | 685 |

EXAMPLE 2

Aqueous dispersions of softeners utilized in this invention were also made in the pilot plant. In one case a coarse dispersion was made by adding 75 grams of softener to 15 liters of tap water to yield a 0.5% by weight solution. For the coarse dispersion, the solution was mildly agitated for one minute at 70° F. using a slow speed 4-inch diameter paddle agitator maintained at 480 rpm.

A finer dispersion was also prepared by rigorously agitating the 0.5% solution for 20 minutes at 70° F. using a high shear 6-inch diameter shear impeller mixer maintained at 3590 rpm. The composition of the active portion of the 0.5% softener dispersion is provided in Table 5.

TABLE 5

| 75% Imidazoline/25% TMPD-1EO | |
|---|---|
| Compound | Weight % |
| Imidazoline | 75% |
| TMPD-$(EO)_n$ | 25% |

The average particle size range of the coarse and fine dispersions are 165 nm and 82 respectively, with standard deviation of: 96 nm and 51 nm, respectively. The average particle size of the softener dispersion was measured by a Nicomp Submicron Particle Size Analyzer.

EXAMPLE 3

Tissue treated with softener made in Example 1 is produced on pilot paper machine. The pilot paper machine is a crescent former operated in the waterformed mode. The furnish was either a 2/1 blend of Northern HWK and Southern SWK or a 2/1 blend of Northern HWK and Northern SWK. A predetermined amount (10 lbs./ton) of a cationic wet strength additive (Cobond 1600), supplied by National Starch and Chemical Co., was added to the furnish.

In one run, an aqueous dispersion of the softener was added to the furnish containing the cationic wet strength additive at the fan pump as it was being transported through a single conduit to the headbox. The stock comprising the furnish, the cationic wet strength additive, and the softener was delivered to the forming fabric to form a nascent/embryonic web. The sheet while on the felt was additionally sprayed with Quasoft 202JR softener, supplied by Quakar Chemical Corporation, Conshohoken, Pa. Dewatering of the nascent web occurred via conventional wet pressing process and drying on a Yankee dryer. Adhesion and release of the web from the Yankee dryer was aided by the addition of adhesive and release agents (Houghton 8302 at 0.07 lbs./ton), respectively. Yankee dryer temperature was approximately 190° C. The web was creped from the Yankee dryer with a square blade at a creping angle of 75 degrees. The basesheets were converted to 560 count products by embossing them with a spot embossing pattern containing crenulated elements at emboss penetration depth of 0.070". The softened one-ply tissue paper product has a basis weight of 18–19 lbs./3000 square foot ream, MD stretch of 18–29%, approximately 0.05 to 0.8% of softener by weight of dry paper, a CD dry tensile greater than 180 grams/3 inches and a CD wet tensile greater than 50 grams/3".

EXAMPLE 4

Tissue papers containing different levels of softener were made according to the method set forth in Example 3. The properties of the softened tissue papers are shown in Table 6.

TABLE 6

| Softener Level (lbs./ton) | Furnish | Basis Weight (lbs./3000 sq. ft. ream) | Total Tensile (g/3") | GM Modulus (g/% Strain) | Surface Friction (GMMMD) | Sensory Softness* |
|---|---|---|---|---|---|---|
| 1 | 2/1 NHWK/SSWK | 18.4 | 968 | 12.9 | .169 | 17.03 |
| 3 | 2/1 NHWK/NSWK | 18.6 | 1034 | 14.1 | .189 | 17.88 |
| 3 | 2/1 NHWK/NSWK | 19.67 | 1000 | 12.6 | .185 | 19.12 |

*A difference of 0.4 sensory softness units is significant at 95% level of significance.

EXAMPLE 5

Basesheets, using a furnish split of 50% SHWK, 20% SSWK, and 30% recycled broke, were made according to the method set forth in Example 3, but without cationic wet strength additive and without Quasoft 202 JR. These sheets were embossed with a spot embossing pattern containing crenulated elements, but at emboss penetration depth of 0.001 inches and at a speed of about 200 fpm. The embossed sheet was treated with softener prepared as described in Example 1, after it has passed the emboss nip. The softened tissue paper product has a basis weight of 16–19 lbs./3000 square foot ream, MD stretch of 18–29%, approximately 0.05 to 0.08% of softener by weight of dry paper, a CD dry tensile greater than 180 grams/3 inches.

EXAMPLE 6

Tissue papers treated without softener, with water and with softener, respectively, were made according to the method set forth in Example 5. The sensory softnesses of the different tissue paper products are compared in Table 7. The tissue paper treated with the softeners prepared according to Example 1 had the highest sensory softness and the lowest total tensiles.

TABLE 7

| Treatment | Treatment Level | Basis Weight (lbs./ream) | Total Tensiles (gram/3") | Sensory Softness* |
|---|---|---|---|---|
| Control | 0 | 17 | 1654 | 15.06 |
| Water | 8% | 17.1 | 1720 | 14.89 |
| Softener | 8% | 17 | 1622 | 16.2 |

*A difference of 0.4 sensory softness units is significant at 95% level of significance.

EXAMPLE 7

The commercial paper machine utilized was a suction breast roll former operated in the waterformed mode. The furnish was comprised of 60% SHWK and 30% recycled fiber and 10% Northern SWK. A predetermined amount (10#/ton) of a cationic wet strength additive (Cobond 1600), supplied by National Starch and Chemical Co., was added to the furnish.

Aqueous dispersion of the softener made in Example 1 was added to the furnish containing the cationic wet strength additive, at the fan pump, as it was being transported through a single conduit to the headbox. The stock comprising of the furnish, the cationic wet strength additive and the softener was delivered to the forming fabric to form a nascentlembryonic web. The sheet was additionally sprayed with Quasoft 202JR softener while on the felt. Dewatering of the nascent web occurred via conventional wet pressing process and drying on a Yankee dryer. Adhesion and release of the web from the Yankee dryer was aided by the addition of the adhesive and release agents (Houghton 8302 at 0.07 lbs./ton), respectively. Yankee dryer temperature was approximately 190° C. The web was creped from the Yankee dryer with a square blade at an angle of 75 degrees. The basesheets were converted to 560 count tissue products by embossing them with a spot embossing pattern containing crenulated elements at emboss penetration depth of 0.070". The softened tissue paper product has a basis weight of 18–19 lbs./3000 square foot ream, MD stretch of 19–29%, approximately 0.05 to 0.8% of softener by weight of dry paper, a CD dry tensile greater than 180 grams/3 inches and a CD wet tensile greater than 50 gramsl3". The softened tissue has a sensory softness greater than 16.4.

EXAMPLE 8

Towel treated with softener made in Example 2 was produced on a pilot paper machine. The pilot paper machine was a crescent former operated in the waterformed mode. The furnish was a 70/30 blend of Southern HWK and Southern SWK. A predetermined amount (10 lbs./ton) of Kymene 557 LX cationic wet strength agent was added to the furnish at the stuff box down leg.

The aqueous dispersion of the softener was added to the furnish at the fan pump as it was being transported through a single conduit to the headbox. The stock comprising of the furnish, Kymene, and the softener was delivered to the forming fabric to form a nascent/embryonic web. Dewatering of the nascent web occurred via conventional wet pressing process and drying on a Yankee dryer. Adhesion and release of the web from the Yankee dryer was aided by the addition of adhesive and release agents (Houghton 8302 at 0.07 lbs./ton), respectively. Yankee dryer temperature was approximately 190° C. The web was creped from the Yankee dryer. The softened towel product having a serpentine configuration had a basis weight of 18–19 lbs./3000 square foot ream, MD stretch of 19–29%, approximately 0.05 to 0.8% of softener by weight of dry paper, a CD dry tensile greater than 180 grams/3 inches and a CD wet tensile greater than 50 grams/3 inches.

EXAMPLE 9

Towels containing different levels of the softener made in Example 2 were produced according to the method set forth in Example 8 and dispersed as described herein. The properties of the softened towel are shown in Tables 8 and 9.

TABLE 8

| Softener Level Fine Dispersion lbs./ton | Wet Geometric Mean Breaking Length (GMBL) in meters | Wet/Dry Geometric Mean Breaking Length (%) | Surface Friction GMMMD | GM Modulus (g/% Strain) |
|---|---|---|---|---|
| 0 | 234 | 32 | .334 | 39 |
| 2 | 227 | 35 | .286 | 33 |
| 4 | 170 | 36 | .297 | 27 |

TABLE 9

| Softener Level Coarse Dispersion | Wet Geometric Mean Breaking Length Meters | Wet/Dry Geometric Mean Breaking Length Percent | Surface Friction (GMMMD) | GM Modulus grams/ % Strain | Simplified Absorbency Test Capacity (g/m$^2$) | Simplified Absorbency Test Rate Grams Per Square Root of Second |
|---|---|---|---|---|---|---|
| 0 | 234 | 32 | .334 | 39 | 5.51 | .086 |
| 2 | 209 | 31.4 | .324 | 32 | 5.96 | .074 |
| 4 | 162 | 34 | .293 | 32 | 5.62 | .077 |

EXAMPLES 10–41

Figure 4:
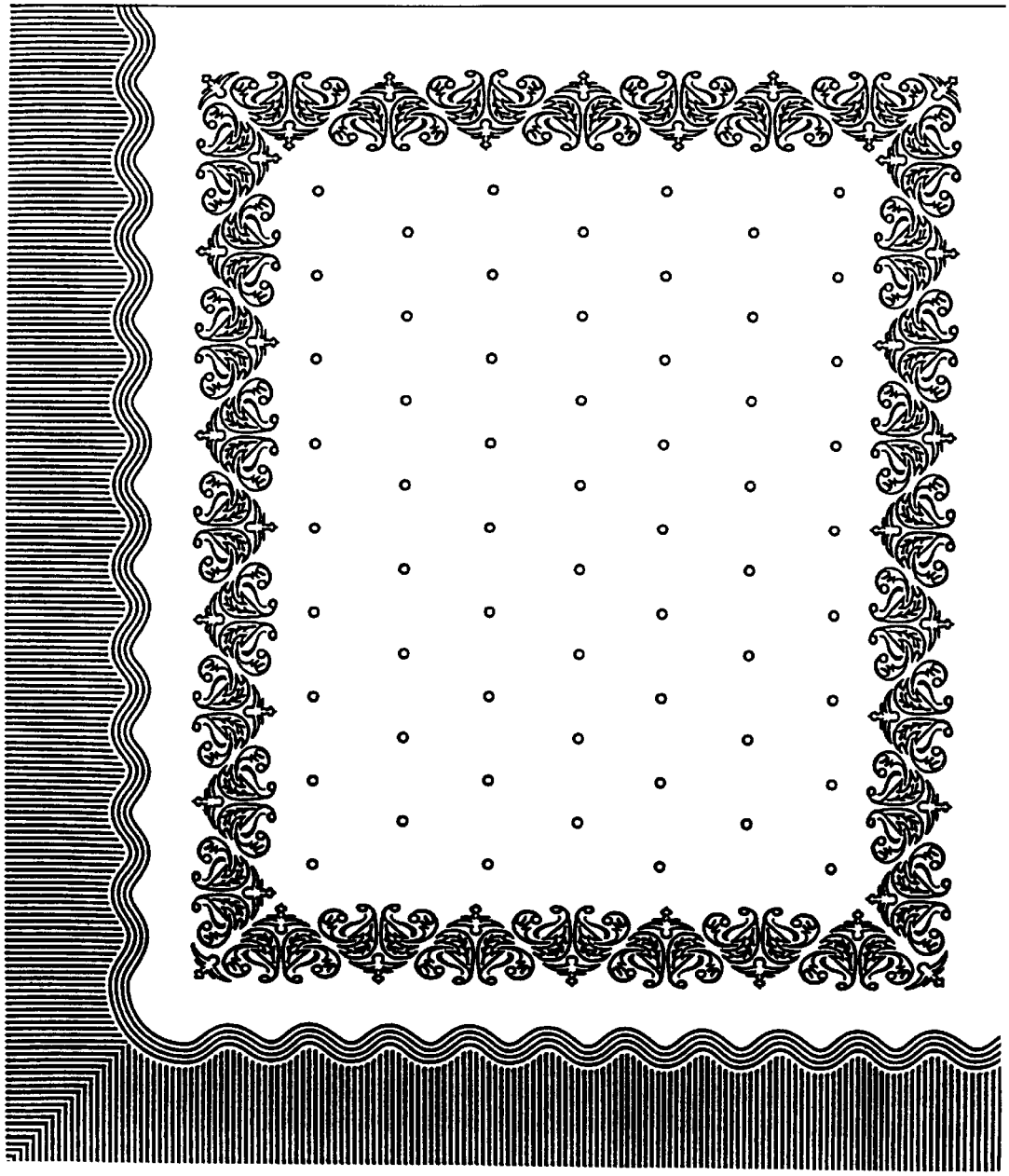
FIGS. 4 and 11 are drawings of the preferred emboss pattern for the one ply napkin of this invention.

The examples in Tables 10–14 demonstrate the superior dinner weight one-ply napkin having a serpentine configuration at a 18 lbs. per 3000 square foot ream basis weight with reduced tensile, increased percent crepe, and sprayed softener produced in Example 1, that achieve the objective of lowering the tensile modulus. The furnish used in Examples 10–16 was a blend of baled West Coast hemlock softwood, alder hardwood, and sawdust. All product conditions were converted into Marathon™ 2574 napkin using the emboss design as shown in FIGS. 4 and 11. All product converted well. Samples of all sixteen conditions and one standard two-ply control were sent for finished product testing (see Table 13) and consumer testing (see Table 14). The reduction in finished product tensile from the converting process averaged about 25%. This led to finished product total MD and CD tensiles in the 2000 to 2400 range.

One-ply napkin base sheets were made on a pilot paper machine as shown in FIG. 1 from a furnish containing a blend of baled West Coast hemlock softwood, alder hardwood, and sawdust. The ratio of the different woods in the furnish are given in Tables 10 to 14. The amount of softener, wet strength agent and properties of the napkins are set forth in Tables 10 to 14. The strength of the napkin sheets was controlled by wet-end addition of the softener made according to the method shown in Example 1. The base sheets were made at different levels of percentage stretch, with the stretch being changed by changing the percentage crepe. In this case, the percentage crepe levels employed were 16% and 21%. The physical properties of the base sheets are shown in Table 12.

In Table 10 the furnish, softener, tensile ratio, and percent crepe are set forth for Examples 10 through 25. Table 11 provides the detailed reaction conditions for Examples 10 through 25.

TABLE 10

Experimental Design

| Example | Furnish (Hem/SD/Alder) | Wet End Softener (lbs/ton) | Spray Softener (lbs./ton) | Tensile Ratio | Crepe (%) |
|---|---|---|---|---|---|
| + | 55/20/25 | 1.5 | 2.0 | 2.0 | 21 |
| – | 40/20/40 | 2 | 0 | 1.5 | 16 |
| 10 | – | – | – | – | – |
| 11 | – | – | – | + | + |
| 12 | – | – | + | + | – |
| 13 | – | – | + | – | + |
| 14 | + | + | + | – | – |
| 15 | + | + | + | + | + |
| 16 | + | + | – | + | – |
| 17 | + | + | – | – | + |
| 18 | + | + | – | – | – |
| 19 | + | + | – | + | + |
| 20 | + | + | + | + | – |
| 21 | + | + | + | – | + |
| 22 | – | – | + | – | – |
| 23 | – | – | + | + | + |
| 24 | – | – | – | + | – |
| 25 | – | – | – | – | + |

Table 11 summarizes paper machine conditions recorded while reels were being produced.

TABLE 11

Conditions

| Example | 10 | 11 | 12 | 13 | 14 | 15 | 16 | 17 |
|---|---|---|---|---|---|---|---|---|
| Furnish (Hem/SD/Ald) | 40/20/40 | 40/20/40 | 40/20/40 | 40/20/40 | 55/20/25 | 55/20/25 | 55/20/25 | 55/20/25 |
| Wet end debonder (pounds per ton) | 0 | 0 | 0 | 0 | 1.5 | 1.5 | 1.5 | 1.5 |
| Adhesive (pounds per ton) | 2.6 | 3.0 | 4.1 | 4.0 | 3.4 | 3.5 | 3.0 | 3.4 |
| Release (pounds per ton) | 0.16 | 0.26 | 0.16 | 0.16 | 0.16 | 0.16 | 0.16 | 0.16 |
| Kymene (pounds per ton) | 5.0 | 5.0 | 5.0 | 5.0 | 5.0 | 5.0 | 5.0 | 5.0 |
| Refining (hp) | 24.5 | 38 | 33 | 25 | 30 | 40 | 40 | 36 |
| Forming loop pH | 8.0 | 8.0 | 8.0 | 8.0 | 7.7 | 8.0 | 8.1 | 8.1 |
| Wire speed (fpm) | 1707 | 1815 | 1707 | 1815 | 1707 | 1815 | 1707 | 1815 |
| Jet/Wire ratio | 1.08 | 1.035 | 1.08 | 1.08 | 1.13 | 1.06 | 1.06 | 1.08 |
| Yankee speed (fpm) | 1707 | 1815 | 1707 | 1815 | 1707 | 1815 | 1707 | 1815 |
| Yankee steam | 40.5 | 45 | 44 | 44 | 40 | 40 | 41 | 40 |

TABLE 11-continued

| Conditions | | | | | | | | |
|---|---|---|---|---|---|---|---|---|
| (psig) | | | | | | | | |
| WE hood temp. (° F.) | 462 | 509 | 511 | 511 | 540 | 518 | 524 | 554 |
| DE hood temp. (° F.) | 392 | 444 | 456 | 456 | 485 | 460 | 474 | 516 |
| Sprayed Softener (pounds per ton) | 0 | 0 | 2.04 | 2.04 | 2.11 | 2.12 | 0 | 0 |
| Reel Crepe (%) | 16 | 21 | 16 | 21 | 16 | 21 | 16 | 21 |
| Example | 18 | 19 | 20 | 21 | 22 | 23 | 24 | 25 |
| Furnish (Hem/SD/Ald) | 55/20/25 | 55/20/25 | 55/20/25 | 55/20/25 | 40/20/40 | 40/20/40 | 40/20/40 | 40/20/40 |
| Wet end debonder (pounds per ton) | 1.5 | 1.5 | 1.5 | 1.5 | 0 | 0 | 0 | 0 |
| Adhesive (pounds per ton) | 3.4 | 3.3 | 4.0 | 3.9 | 3.9 | 4.0 | 3.5 | 3.5 |
| Release (pounds per ton) | 0.16 | 0.15 | 0.16 | 0.15 | 0.15 | 0.15 | 0.15 | 0.15 |
| Kymene (pounds per ton) | 5.0 | 5.0 | 5.0 | 5.0 | 5.0 | 5.0 | 5.0 | 5.0 |
| Refining (hp) | 34 | 10.5 | 10.5 | 37.5 | 31.5 | 39 | 35.5 | 35.5 |
| Forming loop pH | 8.0 | 7.9 | 7.9 | 8.0 | 8.0 | 8.0 | 8.0 | 8.0 |
| Wire speed (fpm) | 1707 | 1815 | 1707 | 1815 | 1707 | 1815 | 1707 | 1815 |
| Jet/Wire ratio | 1.11 | 1.05 | 1.06 | 1.075 | 1.11 | 1.05 | 1.06 | 1.07 |
| Yankee speed (fpm) | 1707 | 1815 | 1707 | 1815 | 1707 | 1815 | 1707 | 1815 |
| Yankee steam (psig) | 40 | 40 | 40 | 39 | 41 | 40 | 40 | 40 |
| WE hood temp. (° F.) | 584 | 601 | 528 | 574 | 539 | 548 | 540 | 540 |
| DE hood temp. (° F.) | 516 | 551 | 480 | 518 | 473 | 500 | 495 | 495 |
| Sprayed Softener (pounds per ton) | 0 | 0 | 2.06 | 2.01 | 2.06 | 2.06 | 0 | 0 |
| Reel Crepe (%) | 16 | 21 | 16 | 21 | 16 | 21 | 16 | 21 |

The physical properties of each of the one-ply napkins are given in Table 12. Two rolls of each example were produced.

TABLE 12

MARATHON ® Napkin Basesheet Physical Properties

| Ex. # | PM Reel No. | Basis Weight | Caliper | MD Dry Tensile | CD Dry Tensile | Ratio | MD % Strain | MD Wet Tensile | CD Wet Tensile | Tensile Modulus | GMMMD Friction |
|---|---|---|---|---|---|---|---|---|---|---|---|
| 10 | 3658-13 | 17.6 | 47.2 | 1446 | 873 | 1.7 | 17.5 | 340 | 169 | — | — |
| 10 | 3658-14* | 18.1 | 47.8 | 1457 | 890 | 1.6 | 17.3 | 305 | 173 | — | — |
| 11 | 3659-8* | 18.1 | 49.1 | 2138 | 1007 | 2.1 | 26.7 | 323 | 147 | 38.4 | 0.212 |
| 11 | 3659-9 | 18.2 | 47.8 | 2207 | 1046 | 2.1 | 25.1 | 464 | 170 | 36.4 | 1.218 |
| 12 | 3659-17 | 18.7 | 47.8 | 2054 | 1100 | 1.9 | 20.4 | 342 | 173 | 41.4 | 0.219 |
| 12 | 3659-18* | 18.1 | 47.5 | 1928 | 1003 | 1.9 | 21.0 | 306 | 155 | 33.3 | 0.211 |
| 13 | 3659-22* | 18.1 | 48.0 | 1343 | 918 | 1.5 | 27.2 | 220 | 139 | 32.4 | 0.202 |
| 13 | 3659-23 | 18.6 | 51.9 | 1310 | 967 | 1.4 | 24.8 | 254 | 155 | 30.0 | 0.207 |
| 14 | 3664-8* | 18.6 | 49.1 | 1473 | 1070 | 1.4 | 20.3 | 303 | 224 | 40.1 | 0.205 |
| 14 | 3664-9 | 18.4 | 48.3 | 1411 | 1063 | 1.3 | 19.4 | 308 | 220 | 38.9 | 0.199 |
| 15 | 3664-13 | 18.2 | 43.8 | 1907 | 896 | 2.1 | 27.1 | 411 | 183 | 36.5 | 0.198 |
| 15 | 3664-14* | 18.3 | 46.4 | 2012 | 975 | 2.1 | 27.1 | 425 | 184 | 37.7 | 0.213 |
| 16 | 3664-17* | 18.4 | 44.6 | 1999 | 1034 | 1.9 | 19.4 | 431 | 184 | 44.1 | 0.185 |
| 16 | 3665-18 | 18.3 | 45.5 | 2236 | 1043 | 2.1 | 19.5 | 302 | 100 | 41.8 | 0.232 |
| 17 | 3665-3* | 18.9 | 51.2 | 1570 | 1093 | 1.4 | 26.9 | 364 | 210 | 32.5 | 0.207 |
| 17 | 3665-4 | 18.8 | 47.8 | 1674 | 1072 | 1.6 | 26.7 | 358 | 200 | 33.8 | 0.229 |
| 18 | 3665-8 | 17.7 | 4831 | 1509 | 1086 | 1.4 | 19.2 | 362 | 222 | 39.8 | 0.213 |
| 18 | 3665-9* | 18.7 | 47.3 | 1579 | 1099 | 1.4 | 17.0 | 368 | 213 | 32.3 | 0.199 |
| 19 | 3665-16 | 18.7 | 49.3 | 1950 | 1040 | 1.9 | 26.5 | 409 | 176 | 30.5 | 0.244 |
| 19 | 3665-17* | 18.5 | 48.5 | 1957 | 993 | 2.0 | 26.1 | 409 | 192 | 35.6 | 0.228 |
| 20 | 3665-21 | 18.2 | 44.3 | 2036 | 990 | 2.1 | 19.4 | 443 | 208 | 38.6 | 0.191 |
| 20 | 3665-22* | 18.1 | 44.6 | 2025 | 971 | 2.1 | 19.9 | 471 | 203 | 34.9 | 0.194 |
| 21 | 3665-28 | 17.9 | 48.8 | 1442 | 907 | 1.6 | 28.3 | 325 | 187 | 26.8 | 0.199 |
| 21 | 3665-29* | 18.1 | 49.7 | 1491 | 954 | 1.6 | 27.4 | 274 | 184 | 26.4 | 0.189 |
| 22 | 3666-8* | 18.4 | 46.5 | 1627 | 1051 | 1.5 | 19.3 | 371 | 185 | 31.5 | 0.216 |

TABLE 12-continued

MARATHON ® Napkin Basesheet Physical Properties

| Ex. # | PM Reel No. | Basis Weight | Caliper | MD Dry Tensile | CD Dry Tensile | Ratio | MD % Strain | MD Wet Tensile | CD Wet Tensile | Tensile Modulus | GMMMD Friction |
|---|---|---|---|---|---|---|---|---|---|---|---|
| 22 | 3666-9 | 18.4 | 48.2 | 1671 | 1038 | 1.6 | 21.0 | 328 | 209 | 26.4 | 0.207 |
| 23 | 3666-15 | 18.3 | 48.9 | 1871 | 934 | 2.0 | 28.1 | 375 | 157 | 30.8 | 0.213 |
| 23 | 3666-16* | 18.7 | 48.7 | 1972 | 1006 | 2.0 | 27.6 | 383 | 179 | 32.2 | 0.192 |
| 24 | 3666-21 | 18.2 | 46.7 | 2180 | 1028 | 2.1 | 18.8 | — | — | 36.5 | 0.231 |
| 24 | 3666-22* | 18.2 | 45.6 | 2074 | 919 | 2.3 | 19.1 | 396 | 160 | 35.9 | 0.222 |
| 25 | 3666-27 | 18.4 | 48.7 | 1530 | 1012 | 1.5 | 25.4 | 296 | 164 | 32.8 | 0.235 |
| 25 | 3666-28* | 17.9 | 48.8 | 1503 | 970 | 1.5 | 25.6 | 288 | 162 | 31.9 | 0.224 |

Note: Rolls marked with an "*" were selected for converting.

The physical properties of the sixteen examples and the control are given in Table 13.

TABLE 13

MARATHON ® Finished Product Attributes

| Ex. # | Basis Weight lbs/Ream | Caliper Mils/ 8 Sheets | MD Dry Tensile g/3 in. | CD Dry Tensile | Ratio | MD % Strain | MD Wet Tensile g/3 in. | CD Wet Tensile | Tensile Modulus g/% Strain | GMMMD Friction |
|---|---|---|---|---|---|---|---|---|---|---|
| 10 | 19.9 | 50.8 | 2211 | 1577 | 1.40 | 10.4 | 551 | 350 | 85.9 | 0.225 |
| 11 | 17.6 | 50.0 | 1154 | 720 | 1.60 | 14.7 | 333 | 157 | 41.9 | 0.216 |
| 12 | 17.9 | 48.6 | 1467 | 802 | 1.83 | 17.5 | 348 | 173 | 42.5 | 0.220 |
| 13 | 17.1 | 50.8 | 986 | 645 | 1.53 | 21.6 | 257 | 147 | 30.4 | 0.226 |
| 14 | 18.0 | 50.0 | 1046 | 779 | 1.34 | 16.7 | 298 | 204 | 36.9 | 0.228 |
| 15 | 17.6 | 47.6 | 1538 | 730 | 2.11 | 23.5 | 420 | 171 | 34.8 | 0.248 |
| 16 | 17.8 | 48.1 | 1528 | 808 | 1.89 | 16.0 | 397 | 173 | 47.5 | 0.266 |
| 17 | 18.3 | 51.5 | 1311 | 950 | 1.38 | 21.7 | 351 | 193 | 38.8 | 0.244 |
| 18 | 18.0 | 48.7 | 1148 | 843 | 1.36 | 15.3 | 322 | 205 | 38.8 | 0.221 |
| 19 | 18.1 | 48.7 | 1586 | 817 | 1.94 | 23.6 | 375 | 166 | 37.1 | 0.236 |
| 20 | 18.0 | 45.8 | 1667 | 816 | 2.04 | 17.7 | 425 | 188 | 43.9 | 0.228 |
| 21 | 18.0 | 50.3 | 1237 | 760 | 1.63 | 22.0 | 314 | 170 | 33.1 | 0.217 |
| 22 | 17.9 | 49.0 | 1088 | 791 | 1.38 | 16.2 | 294 | 174 | 40.2 | 0.239 |
| 23 | 17.8 | 49.1 | 1483 | 737 | 2.01 | 23.9 | 352 | 146 | 32.9 | 0.282 |
| 24 | 18.3 | 47.6 | 1589 | 739 | 215 | 16.1 | 357 | 144 | 49.0 | 0.224 |
| 25 | 17.9 | 54.1 | 1187 | 819 | 1.45 | 20.7 | 274 | 147 | 36.4 | 0.241 |

In Table 14, the panel test product preference results for commercial two-ply napkin products compared to one-ply napkins of this invention are summarized. These results indicate that the one-ply napkins of this invention are equivalent or better in consumer perception than conventional two-ply napkins on the market.

TABLE 14

The Panel Test Results

| Code | Overall Performance | Grease Cleaning | Softness | Absorbency | Holding Together | Thickness | Sticking To Hands | Amount of Lint | Pieces Stuck To Skin |
|---|---|---|---|---|---|---|---|---|---|
| Control two-ply | 5.13 | 5.00 | 4.94 | 5.25 | 5.38 | 5.00 | 1.25 | 1.25 | 1.25 |
| Example 10 | 5.00 | 5.24 | 5.35 | 5.18 | 5.29 | 5.47 | 1.12 | 1.35 | 1.12 |
| Example 11 | 5.06 | 5.06 | 4.94 | 5.06 | 5.00 | 4.94 | 1.44 | 1.44 | 1.19 |
| Example 12 | 5.38 | 5.25 | 5.06 | 5.13 | 5.31 | 4.94 | 1.31 | 1.38 | 1.13 |
| Example 13 | 5.19 | 5.25 | 5.19 | 5.19 | 5.13 | 4.75 | 1.38 | 1.38 | 1.13 |
| Example 14 | 5.50 | 5.38 | 5.38 | 5.38 | 5.38 | 5.25 | 1.25 | 1.56 | 1.00 |
| Example 15 | 5.00 | 4.63 | 5.25 | 5.06 | 5.13 | 4.94 | 1.31 | 1.38 | 1.06 |

TABLE 14-continued

The Panel Test Results

| Code | Overall Performance | Grease Cleaning | Softness | Absorbency | Holding Together | Thickness | Sticking To Hands | Amount of Lint | Pieces Stuck To Skin |
|---|---|---|---|---|---|---|---|---|---|
| Example 16 | 5.12 | 5.35 | 4.65 | 5.06 | 5.18 | 5.12 | 1.29 | 1.59 | 1.06 |
| Example 17 | 4.94 | 4.94 | 4.69 | 4.94 | 5.06 | 4.88 | 1.50 | 1.44 | 1.06 |
| Example 18 | 5.40 | 5.56 | 5.38 | 5.50 | 5.38 | 5.25 | 1.25 | 1.38 | 1.00 |
| Example 19 | 5.19 | 5.31 | 4.69 | 5.13 | 5.25 | 4.81 | 1.19 | 1.25 | 1.13 |
| Example 20 | 5.38 | 5.31 | 5.13 | 5.31 | 5.56 | 5.44 | 1.25 | 1.50 | 1.13 |
| Example 21 | 5.13 | 5.06 | 5.06 | 5.00 | 4.63 | 5.25 | 1.33 | 1.40 | 1.33 |
| Example 22 | 4.94 | 5.06 | 5.13 | 4.88 | 4.69 | 5.31 | 1.31 | 1.69 | 1.25 |
| Example 23 | 5.24 | 5.18 | 5.35 | 5.18 | 5.41 | 5.06 | 1.29 | 1.12 | 1.06 |
| Example 24 | 4.75 | 4.94 | 4.88 | 4.74 | 4.19 | 5.19 | 1.40 | 1.47 | 1.20 |
| Example 25 | 5.35 | 5.53 | 5.06 | 5.41 | 5.53 | 4.94 | 1.12 | 1.18 | 1.00 |

Rating scale is 1–7, 7 = Highest
The last three columns represent exact numbers of times particles were observed by the panelists.

EXAMPLE 42

Creped TAD Sheet

A one-ply tissue base sheet was formed as a three layered sheet. The sheet contained 60% Eucalyptus, and 40% Northern Softwood Kraft. The eucalyptus was equally split between the two outer layers, with the inner layer containing all of the softwood. Two pounds per ton of a temporary wet strength starch was added to both furnishes. Five pounds per ton of softener prepared, as shown in Example 1, was added to the center layer of the sheet. The sheet was formed on a forming fabric and transferred to a through-air drying fabric. While on this fabric, the sheet was dried using a through-air drying unit to a solids content of 89 percent. The sheet was then adhered to a Yankee dryer and further dried to a solids content of 99 percent. the sheet was creped from the Yankee dryer using a 15-degree-beveled creping blade and a creping angle of 86 degrees. The percent crepe was 16 percent. The creped base sheet had a serpentine configuration and the physical propertied shown in Table 15.

EXAMPLE 43

Uncreped TAD Sheet

A one-ply tissue base sheet was formed as a three layered sheet. The sheet contained 60% Eucalyptus, and 40% Northern Softwood Kraft. The eucalyptus was equally split between the two outer layers, with the inner layer containing all of the softwood. Two pounds per ton of a temporary wet strength starch was added to both furnishes. Five pounds per ton of softener prepared as shown in Example 1 was added to the center layer of the sheet. The sheet was formed on a forming fabric and transferred to a through-air drying fabric. While on this fabric, the sheet was dried using a through-air drying unit to a solids content of 89 percent. The sheet was then adhered to a Yankee dryer and further dried to a solids content of 99 percent. The sheet was peeled from the Yankee dryer without being creped. The physical properties of the uncreped base sheet are shown in Table 16.

TABLE 15

Physical Properties of Creped TAD Tissue Base Sheet

| Basis Weight (lbs. 3000 sq. ft. ream) | Caliper (mils/8 sheets) | MD Tensile (grams/3") | CD Tensile (grams/3") | MS Strength (%) | CD Stretch (%) | CD Wet Tensile (grams/3") |
|---|---|---|---|---|---|---|
| 18.8 | 103.1 | 1215 | 754 | 20.3 | 2.3 | 102 |

TABLE 16

| Physical Properties of Creped TAD Tissue Base Sheet | | | | | | |
|---|---|---|---|---|---|---|
| Basis Weight (lbs./3000 sq. ft. ream) | Caliper (mils/8 sheets) | MD Tensile (grams/3") | CD Tensile (grams/3") | MS Strength (%) | CD Stretch (%) | CD Wet Tensile (grams/3") |
| 16.3 | 76.7 | 1533 | 1074 | 4.3 | 1.8 | 79 |

This sheet did not have a serpentine configuration.

EXAMPLE 44

In order to understand the mechanism of retention and softening attributed to V475/TMPD-1EO when applied to various towel and tissue products, data was obtained on the particle size distributions of water dispersion of V475/TMPD-1EO and V475/PG. The 475/TMPD-1EO formulation contained 75% V475 and 25% TMPD-1EO. The V475/PG formulation contained 90% V475 and 10% propylene glycol. The dispersions were prepared using either boiling water (100° C.) or room temperature water (22°) and mixed for 2 minutes using either high or low shear conditions. In all cases, the dispersions were 5% by weight in V475. Low shear was defined as mixing with a magnetic stirrer using a 1 inch stir bar for 2 minutes at approximately 1000 rpm. High shear was defined as mixing with a Waring blender using a 4-blade propeller for 2 minutes at approximately 10,000 rpm. Speed of rotation was measured with a stroboscope.

The Nicomp, Model 270 submicron particle size analyzer was used to measure the particle size distribution for each dispersion. The data show that V475/PG could not be dispersed in room temperature water with a magnetic stirrer. The V475/PG could be dispersed in room temperature water when mixed under high shear conditions.

Our data demonstrate that extremely small particle size, less than 20 nm, usually about 15 nm were obtained with V475/TMPD-1EO formulation when mixed with boiling water under high shear conditions. Under the same conditions of temperature and shear, the smallest particle sizes obtained with the V475/PG formulation were in the 200 nm range. The presence of TMPD aids in producing dispersions that have a higher population of smaller particles. Particle size may play a roll in differentiating the performance of the PG and TMPD versions of V475. Some of these particles are small enough to enter the walls of the fiber. It is believed that the softener which penetrates the fiber wall has improved product performance compared to softeners which remain completely on the surface of the fiber. The results are set forth in Table 17.

TABLE 17

| | Low Shear, 22° C. | | Low Shear, 100° C. | | High Shear, 22° C. | | High Shear, 100° C. | |
|---|---|---|---|---|---|---|---|---|
| Sample | Size (nm) | Vol. % | Size (nm) | Vol. % | Size (nm) | Vol. % | Size (nm) | Vol. % |
| TMPD | 595 | 94 | 1005 | 92 | 160 | 74 | 238 | 1 |
| | 135 | 6 | 218 | 8 | 51 | 26 | 57 | 22 |
| | | | | | | | 15 | 77 |
| PG | Could Not Disperse | | 960 | 94 | 224 | 100 | 193 | 100 |
| | | | 188 | 6 | | | | |

EXAMPLE 45

Parez® 745 is a glyoxylated poly(acrylamide-co-DADMAC) that has a broad molecular weight distribution in a low molecular weight range. (Please note that DADMAC is diallyl dimethyl ammonium chloride.) The results of both analyses are summarized below.

TABLE 18

| Chemical Composition of As-Received Parez ® 745 | | | |
|---|---|---|---|
| Weight % Solids | Weight % Active Polymer | Weight % Free Glyoxal | Weight % Free DADMAC |
| 19.8 | 16.6 | 2.1 | 1.1 |

| Chemical Composition of Parez ® 745 Active Polymer (Calculated from NMR data that shows the polymer is 84.2% of the solids) | | | |
|---|---|---|---|
| Weight % Acrylamide-No Bound Glyoxal | Weight % Acrylamide With One Bound Glyoxal | Weight % Acrylamide Crosslinked With Glyoxal | Weight % DADMAC |
| 43.1 | 28.0 | 18.7 | 10.2 |

TABLE 19

| GPC of Parez ® 745 | | | | |
|---|---|---|---|---|
| Number Average (Mn) | Peak Molecular Weight (Mp) | Weight Average (Me) | Z-Average (Mz) | Polydispersity (Mw/Mn) |
| 230 | 380 | 49,900 | 260,100 | 216 |

METHODS OF ANALYSIS

Weight % Solids

Approximately 2 grams of Parez® 745 was weighed to the nearest 0.1 mg in a pre-weighed aluminum pan. The sample was dried at 105° C. until constant weight was achieved (four hours total drying time). The solids weight remaining in the pan was used to calculate weight % solids.

Chemical Composition

In Table 20, the analytical results are shown using nuclear magnetic resonance spectrometry (NMR) to analyze the as-received Parez® 745. Please note that the NMR data was used along with the weight % solids data to calculate the % composition of the as-received Parez® 745 in Table 18.

Molecular Weight Distribution

The sample was diluted with eluent (see below) to obtain a solution with 0.5% solids, which was filtered through a 0.5 micron Whatman® Autovial® filter prior to analysis by gel permeation chromatography (GPC) using the following conditions. Molecular weight averages are calculated based on poly(vinyl pyridine) standards.

Columns: Catsec® 4000, 1000, 300, 100 at 35° C. (Micra Scientific)

Flow: 1.0 mL/min.

Eluent: 0.6% NaNO3+0.06% TFA (trifluoroacetic acid) in 70/30 water/acetonitriie

Injector: 200 uL

Detector: Waters® 410 refractometer at +128 (35° C.)

Data: 90 minute runs using Waters® Millennium® GPC software on a Waters® Millennium-32® Data System

TABLE 20

Composition Analysis Determined by Carbon-13 NMR

| | Mole % of Polymer | | | | Weight % of Solids | | | | | | Charge |
|---|---|---|---|---|---|---|---|---|---|---|---|
| | | | | | Polymer | | | | | | |
| | | Glyoxalated Acrylamide | | | | Glyoxalated Acrylamid | | | Free Components | | Density |
| Sample | Acrylamid | mono-bound | di-bound | DADMAC | Acrylamid | mono-bound | di-bound | DADMAC | Glyoxal | DADMAC | Meq/g |
| Parez 745 | 58.0 | 18.2 | 17.8 | 6.0 | 36.3 | 23.6 | 15.7 | 8.6 | 10.5 | 5.4 | 0.53 |
| Parez 631NC | 79.5 | 13.3 | 2.5 | 4.7 | 53.3 | 18.5 | 2.4 | 7.1 | 18.8 | 0 | 0.44 |

We claim:

1. A hydrophilic, humectant, soft, pliant single-ply or multi-ply absorbent through dried bathroom tissue to which an organic permanent or temporary wet strength agent has been added, said bathroom tissue formed from cellulosic fibers and optionally up to 50% synthetic fibers and a softener having a melting range of about 0°–40° C. wherein the softener comprises an imidazoline moiety formulated with organic compounds having a weight average molecular weight of about 60 to 1500 selected from the group consisting of alkoxylated polyols, alkoxylated diols, aliphatic diols, aliphatic polyols, and a mixture of these compounds, the amount of softener added is about 1 to 10 pounds per ton of furnish, but within these parameters the addition of the softener is controlled to achieve a ratio of average particle size of dispersed softener to average fiber diameter in the range of about 0.01 to 15 percent, the amount of wet strength agent added per ton of furnish is about 1 to 20 pounds.

2. A hydrophilic, humectant, soft, pliant single-ply or multi-ply through dried absorbent bathroom tissue to which an organic permanent or temporary wet strength agent has been added, the amount of wet strength agent added is about 1 to 20 pounds per ton of furnish, said bathroom tissue having a serpentine configuration formed from cellulosic fibers and optionally up to 50% synthetic fibers and a softener having a melting range of about 0°–40° C., the amount of softener added is about 1 to 10 pounds per ton of furnish, but within these parameters the addition of the softener is controlled to achieve a ratio of average particle size of dispersed softener to average fiber diameter in the range of about 0.01 to 15 percent, wherein the softener comprises an imidazoline moiety formulated with organic compounds having a weight average molecular weight of about 60 to 1500 selected from the group consisting of alkoxylated polyols, alkoxylated diols, aliphatic diols, aliphatic polyols, and a mixture of these compounds; and wherein said bathroom tissue is formed by adhering the web comprising cellulosic fibers and optionally up to 50% synthetic fiber to a Yankee dryer and creping the web from the Yankee dryer.

3. The absorbent bathroom tissue of claim 1 or claim 2 wherein the imidazoline moiety is of the following formula:

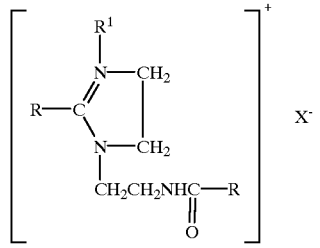

wherein X is an anion and R is selected from the group of saturated and unsaturated paraffinic moieties having a carbon chain length of $C_{11}$ to $C_{19}$ and $R^1$ is selected from paraffinic moieties having a carbon chain length of $C_1$ to $C_3$.

4. The absorbent bathroom tissue of claim 3 wherein X is selected from the group of methyl and ethyl sulfate.

5. The absorbent bathroom tissue of claim 3 wherein X is the chloride ion.

6. The absorbent bathroom tissue of claim 1 or claim 2 wherein the synthetic fiber is selected from the group consisting of the following polymers: polyethylene, polypropylene, polyether, polyamide, polyacrylic and mixtures of these.

7. The absorbent bathroom tissue of claim 6 wherein R has an average chain length of $C_{16}$–$C_{19}$.

8. The absorbent tissue of claim 1 or claim 2 wherein the diol is 2,2,4 trimethyl 1,3 pentane diol (TMPD).

9. The absorbent bathroom tissue of claim 1 or claim 2 wherein the alkoxylated diol is TMPD-$(EO)_n$ wherein $_n$ is an integer from 1 to 7 inclusive.

10. The absorbent tissue of claim 9 wherein the alkoxylated diol is ethoxylated 2,2,4 trimethyl 1,3 pentane diol (TMPD-EO).

11. The absorbent bathroom tissue of claim 1 or claim 2 wherein the process of adding the softener is controlled to achieve a ratio of the average particle size of the dispersed softener to the average fiber diameter in the range of about 0.01 to about 15 percent and wherein the amount of wet strength agent added is about 2 to 10 pounds per ton of furnish.

12. The absorbent bathroom tissue of claim 1 or claim 2 where the process of adding the softener is controlled to achieve a ratio of average particle size of dispersed softener to average fiber diameter in the range of about 0.3 to 5 percent.

13. The bathroom tissue of claim 2 wherein the wet strength agents are reaction products of aldehydes with polymers capable of imparting a positive charge to the wet strength agent selected from the group consisting of vinylamides and acrylamides.

14. The bathroom tissue of claim 2 wherein the wet strength agent is glyoxylated polyacrylamide.

15. The bathroom tissue of claim 2 wherein the wet strength agent is a cationic glyoxylated poly(acrylamide co-diallyl dimethyl ammonium chloride).

16. The bathroom tissue of claim 2 wherein the wet strength agent is the reaction product of a polyamide, polycarboxylic acid, a dialdehyde, and epichlorohydrin.

17. The bathroom tissue of claim 2 wherein the wet strength agent is a reaction product of a polyamidoamine and a dialdehyde forming chain extended polymers which are reacting with epichlorohydrin.

18. The bathroom tissue of claim 2 wherein the wet strength agent is an intra linked polyamidoamine which is non-thermosetting and end capped.

19. The bathroom tissue of claim 2 having a wet strength agent present wherein the wet strength agent comprising aldehyde groups and has the formula:

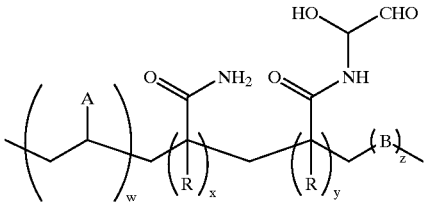

wherein A is a polar, non-nucleophilic unit which does not cause said resin polymer to become water-insoluble; B is a hydrophilic, cationic unit which imparts a positive charge to the resin polymer; each R is H, $C_1$–$C_4$ alkyl or halogen; wherein the mole percent of W is from about 58% to about 95%; the mole percent of X is from about 3% to about 65%; the mole percent of Y is from about 1% to about 20%; and the mole percent from Z is from about 1% to about 10%; said wet strength agent having a molecular weight of from about 5,000 to about 200,000.

20. The bathroom tissue of claim 2 having a wet strength agent present, the water soluble cationic wet strength agent comprising aldehyde units which have molecular weights of from about 20,000 to about 200,000, and are of the formula:

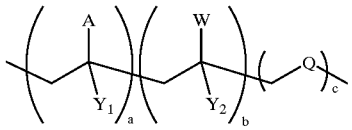

wherein A is

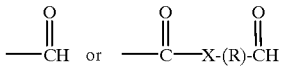

and X is —O—, —NH—, or —$NCH_3$— and R is a substituted or unsubstituted aliphatic group; $Y_1$ and $Y_2$ are independently —H, —$CH_3$, or a halogen, such as CE or F; W is a nonnucleophilic, water-soluble nitrogen heterocyclic moiety; and Q is a cationic monomeric unit, the mole percent of "a" ranges from about 30% to about 70%, the mole percent of "b" ranges from about 30% to about 70%, and the mole percent of "c" ranges from about 1% to about 40%.

21. The bathroom tissue of claim 2 having a wet strength agent present wherein the wet strength agent has the following structure:

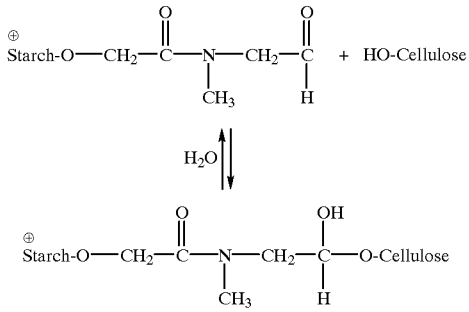

22. The bathroom tissue of claim 2 wherein the wet strength agents are aliphatic and aromatic aldehydes.

23. The bathroom tissue of claim 2 wherein the wet strength agent is selected from the following aliphatic and aromatic aldehydes: glyoxal, malonic dialdehyde, succinic dialdehyde, glutaraldehyde, and mixtures of these.

* * * * *